US006676382B2

(12) United States Patent
Leighton et al.

(10) Patent No.: US 6,676,382 B2
(45) Date of Patent: Jan. 13, 2004

(54) SUMP PUMP MONITORING AND CONTROL SYSTEM

(75) Inventors: Harold Leighton, Tega Cay, SC (US); Philip A. Mayleben, Edgewood, KY (US); Scott R. Graham, West Chester, OH (US); Buford A. Cooper, Sunman, IN (US)

(73) Assignee: Campbell Hausfeld/Scott Fetzer Company, Harrison, OH (US)

( * ) Notice: Subject to any disclaimer, the term of this patent is extended or adjusted under 35 U.S.C. 154(b) by 0 days.

(21) Appl. No.: 10/233,832

(22) Filed: Aug. 29, 2002

(65) Prior Publication Data

US 2003/0049134 A1 Mar. 13, 2003

Related U.S. Application Data

(63) Continuation-in-part of application No. 09/717,976, filed on Nov. 20, 2000, now Pat. No. 6,443,715.

(60) Provisional application No. 60/166,567, filed on Nov. 19, 1999.

(51) Int. Cl.[7] ..... F04B 49/04; F04B 49/00; F04B 17/00

(52) U.S. Cl. ..... 417/40; 417/12; 417/18; 417/44.1; 417/63; 417/280; 417/423.3

(58) Field of Search ..... 417/40, 12, 18, 417/20, 42, 43, 44.1, 423.1, 423.7, 280, 63, 423.3; 416/3

(56) References Cited

U.S. PATENT DOCUMENTS

| | | | | |
|---|---|---|---|---|
| 3,634,842 A | | 1/1972 | Niedermeyer | |
| 4,313,060 A | | 1/1982 | Fickenscher et al. | |
| 4,686,439 A | | 8/1987 | Cunningham et al. | |
| 5,135,359 A | | 8/1992 | Dufresne | |
| 5,234,319 A | | 8/1993 | Wilder | |
| 5,545,012 A | * | 8/1996 | Anastos et al. | 417/44.11 |
| 5,549,456 A | * | 8/1996 | Burrill et al. | 417/12 |
| 5,672,050 A | | 9/1997 | Webber et al. | |
| 5,692,882 A | | 12/1997 | Bozeman, Jr. et al. | |
| 5,765,995 A | * | 6/1998 | Springer | 417/40 |

* cited by examiner

*Primary Examiner*—Justine R. Yu
*Assistant Examiner*—Michael K. Gray
(74) *Attorney, Agent, or Firm*—Jones Day

(57) ABSTRACT

Motor speed, motor amps, float position and elapsed run time are monitored to determine whether a sump pump is in a normal condition, a jammed condition, an inadequate pumping rate condition, a dry running condition or a stuck float condition. A processor is configured to increase the motor speed in response to an inadequate pumping rate condition, and to rapidly energize the motor clockwise and counterclockwise in response to a jammed condition or a stuck float condition. The processor provides signals to a display for displaying information about the condition that the pump is in. The pump is set up to receive power from either an AC power source or a battery power source. Availability of the AC power source is monitored and the pump is switched to operate from the battery power source when AC power is unavailable.

33 Claims, 18 Drawing Sheets

FIG. 19
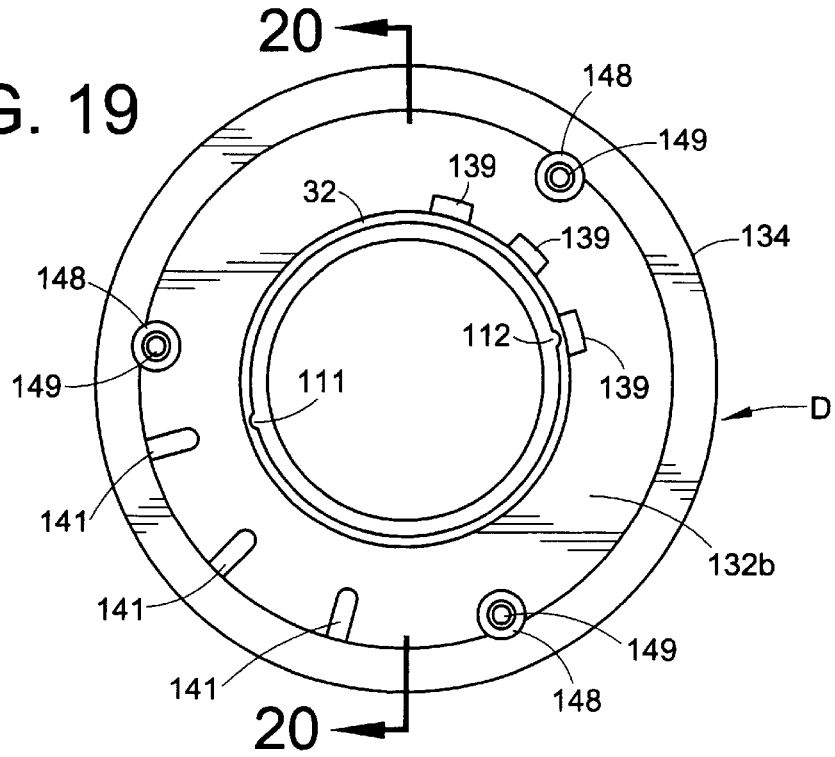
FIG. 20
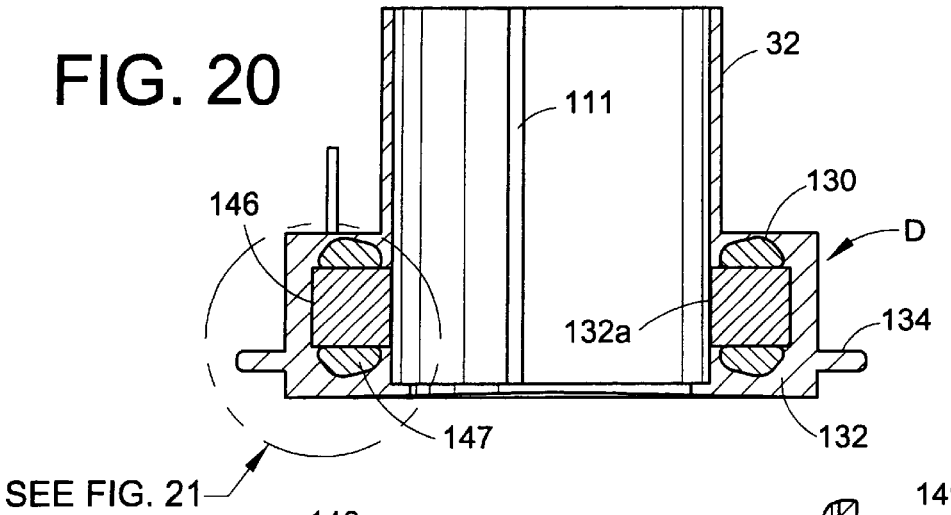
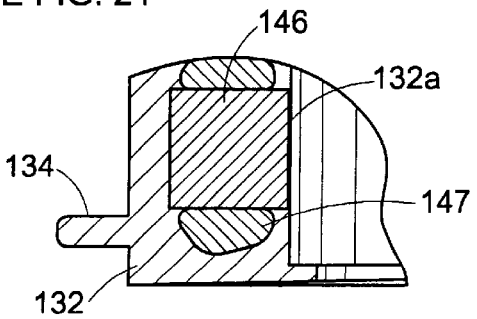
FIG. 21
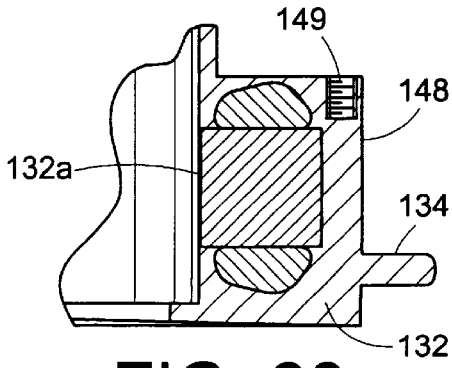
FIG. 22

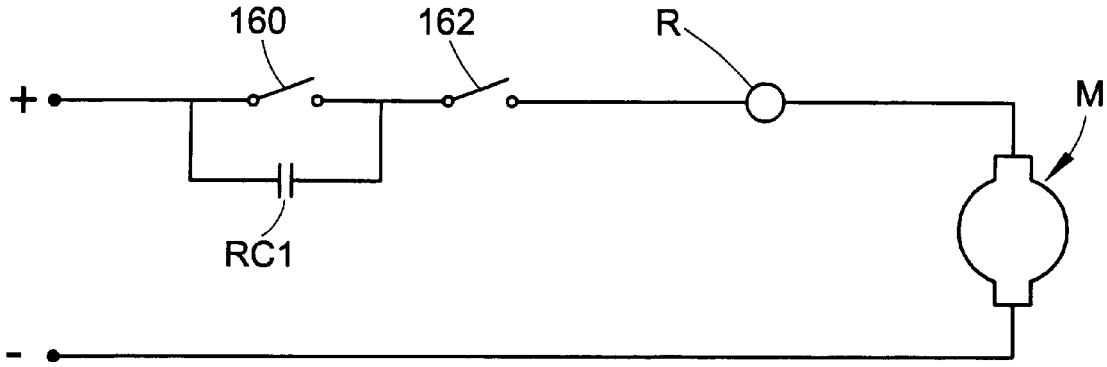
FIG. 30
FIG. 31
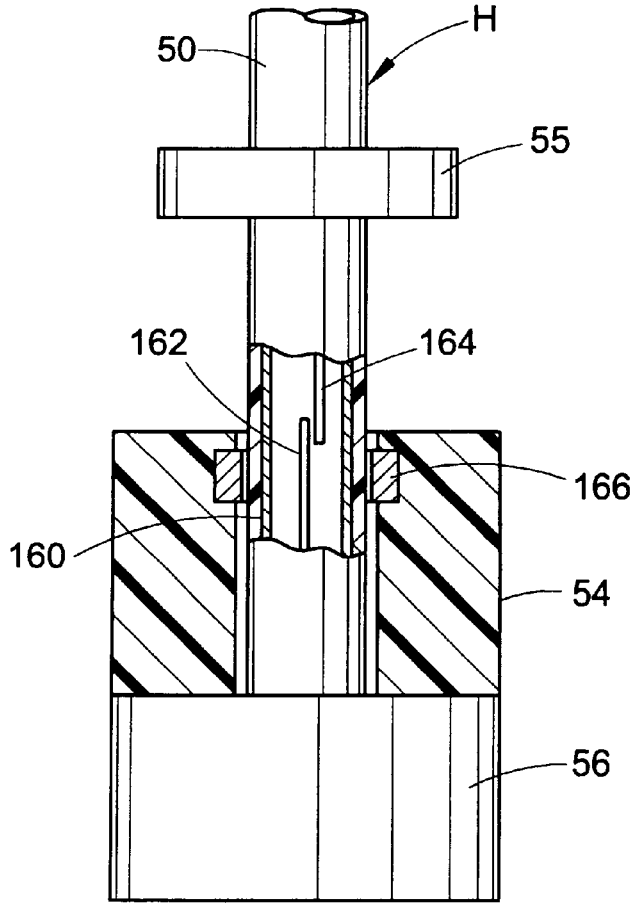

SUMP PUMP MONITORING AND CONTROL SYSTEM

REFERENCE TO RELATED APPLICATIONS

This application is a continuation-in-part of U.S. patent application Ser. No. 09/717,976 filed Nov. 20, 2000, now U.S. Pat. No. 6,443,715 issued Sep. 3, 2002, which in turn is a conversion of U.S. Provisional Patent Application Serial No. 60/166,567 filed Nov. 19, 1999.

BACKGROUND OF THE INVENTION

This application relates to the art of pumps and, more particularly, to controls for monitoring a plurality of different pump conditions and providing visual and/or audible notification of the pump status. The application also concerns controls for operating a pump in different modes in response to certain of the monitored conditions. The invention is particularly applicable for use with sump pumps and will be described with specific reference thereto. However, it will be appreciated that many features of the invention have broader aspects and can be used with other types of pumps.

Sump pumps often fail to operate for a variety of reasons including a power outage, a jammed impeller, a clogged inlet or outlet, or a stuck float. It would be desirable to have an arrangement for monitoring the pump condition and initiating self-repair operation in an attempt to correct certain conditions. It also would be desirable to provide a signaling arrangement for providing information as to the status of the pump.

SUMMARY OF THE INVENTION

A sump pump monitoring and control system includes a processor that constantly monitors float position, motor speed, motor amps, elapsed normal run time, AC power availability and backup battery voltage. Based on these parameters, the processor provides visual and/or audible information about the status of the pump. Using input signals from the same monitored parameters, the processor may attempt self-repair or change the pump operating mode to correct certain conditions.

If the motor speed is zero and the amps are high or normal, there may be a foreign object jammed between rotating and stationary parts. The processor responds by alternately energizing the motor clockwise and counterclockwise at high frequency to vibrate and shake the pump in an attempt to dislodge the object. The same procedure can be used in an attempt to dislodge a stuck float.

A normal sump pump on cycle is around 5–10 seconds after which the upper float has fallen to a position for deenergizing the pump. If the pump remains on after around 5–10 seconds, it may be indicative of a clogged outlet or an inrush of water at a more rapid rate than the pump can remove. The processor responds by operating the motor at higher speed to handle the excessive water inflow or to dislodge the outlet clog by the higher pressure pump discharge.

Motor rotation at normal speed while drawing low amps with both floats floating suggests dry running and the inlet filter may be clogged. The processor will provide a warning by way of an LCD display and/or an audible alarm.

The system includes battery backup in the event AC power is unavailable. The system automatically senses the absence of AC power and switches to battery backup power. Every 24 hours, the system performs a self-check to determine whether problems exist and provides warning signals when problems are found. The system is operable on one twelve volt battery or two twelve volt batteries connected in series. The processor and a control circuit automatically provide the correct voltage to the motor. The control system automatically charges the battery and provides warnings when the battery will not charge, has failed or has bad connections.

It is a principal object of the present invention to provide an improved monitoring and control system for a sump pump.

It is another object of the present invention to provide a sump pump control system that is capable of self-diagnosis and self-repair of certain pump conditions.

BRIEF DESCRIPTION OF THE DRAWING

FIG. 19 is a top plan view thereof;

FIG. 20 is a cross-sectional elevational view thereof;

FIG. 21 is an enlarged detail of the circled detail in FIG. 20;

FIG. 22 is an enlarged detail showing an attachment post on the stator assembly for a pc board;

FIG. 30 is a diagrammatic showing of how a pair of float switches can be used to operate a pump motor;

FIG. 31 is a cross-sectional elevational view of a reed float switch;

DESCRIPTION OF A PREFERRED EMBODIMENT

Figure 1:
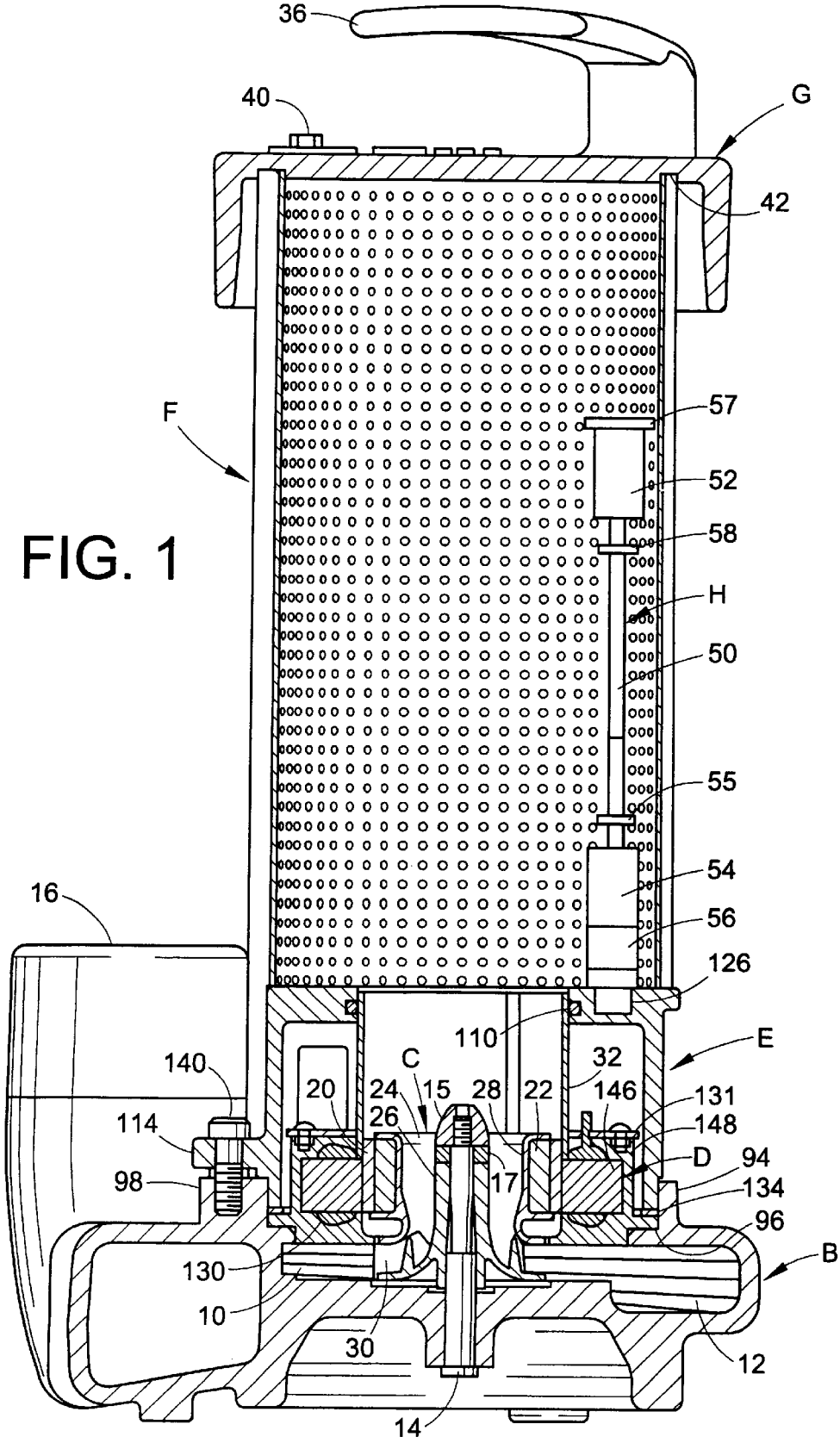
FIG. 1 is a cross-sectional elevational view of a sump pump having the improved features of the present application incorporated therein.

Referring now to the drawings, wherein the showings are for purposes of illustrating certain preferred embodiments of the invention only and not for purposes of limiting same, FIG. 1 shows a pump base B having a pinched vaneless diffuser 10 and a volute 12 therein. A vertical shaft 14 attached to base B has an impeller C rotatably mounted thereon. Impeller C is secured on shaft 14 by a cone nut 15 threaded onto the upper end portion of shaft 14, and a thrust bearing bushing 17 is interposed between the nut and the top end of the impeller hub. Impeller vanes located in diffuser 10 increase the static pressure and velocity of liquid entering the vanes by operation of centrifugal force as the impeller rotates. The liquid is discharged from diffuser 10 to volute 12 and then through base outlet 16 that is attached to an outlet pipe in a known manner.

A reversible brushless permanent magnet motor includes a stator D secured to base B in surrounding relationship to impeller C. A permanent magnet motor ring 20 is attached to a steel ring 22 on impeller C for cooperating with stator D to impart rotation to impeller C when the motor is energized.

An annular liquid inlet passage 24 surrounds impeller hub 26, and is located between hub 26 and an annular shroud 28 that is located in outwardly-spaced relationship to hub 26. Annular inlet passage 24 leads to the impeller vanes, only one of which is generally indicated at 30 in FIGS. 1 and 2.

Permanent magnet motor stator D is encapsulated in plastic material to define a stator housing having an integral cylindrical sleeve 32 extending upwardly therefrom through a suitable hole in a motor cover E which is attached to pump base B and also secures motor stator D thereto. Incoming water enters sleeve 32 and flows through annular impeller inlet passage 24 to impeller vanes 30 for discharge through outlet 16.

A cylindrical filter assembly F is attached to motor cover E for filtering liquid that flows to sleeve 32. A filter cover G having a handle 36 thereon overlies filter assembly F and is attached to motor cover E by a plurality of elongated bolts, only one of which is generally shown at 40 in FIG. 1. A plurality of the circumferentially-spaced bolts 40 extend through suitable holes in cover G along the outside of filter assembly F and thread into tapped holes in ears that extend outwardly from motor cover E. A downwardly opening circular channel 42 in the underside of filter cover G receives the top end portion of filter assembly F.

A float switch assembly H for operating the motor is attached to motor cover E within filter assembly F for protecting same against damage and against fouling by debris. Filter assembly H includes an elongated mast 50 having upper and lower floats 52, 54 slidable thereon for operating upper and lower float switches. Bottom float 54 moves between stops 55 and 56, while upper float 52 moves between upper and lower stops 57 and 58. Stop 58 on the upper end of mast 50 extends outwardly beyond float 52 into engagement with the interior surface of filter assembly F to stabilize filter assembly H and ensure that floats 52, 54 remain out of engagement with filter assembly F for reliable operation. The float switch assembly is illustrated in the sectional view of FIG. 1 in a circumferentially displaced position from its actual position for clarity of illustration and explanation.

Figure 2:
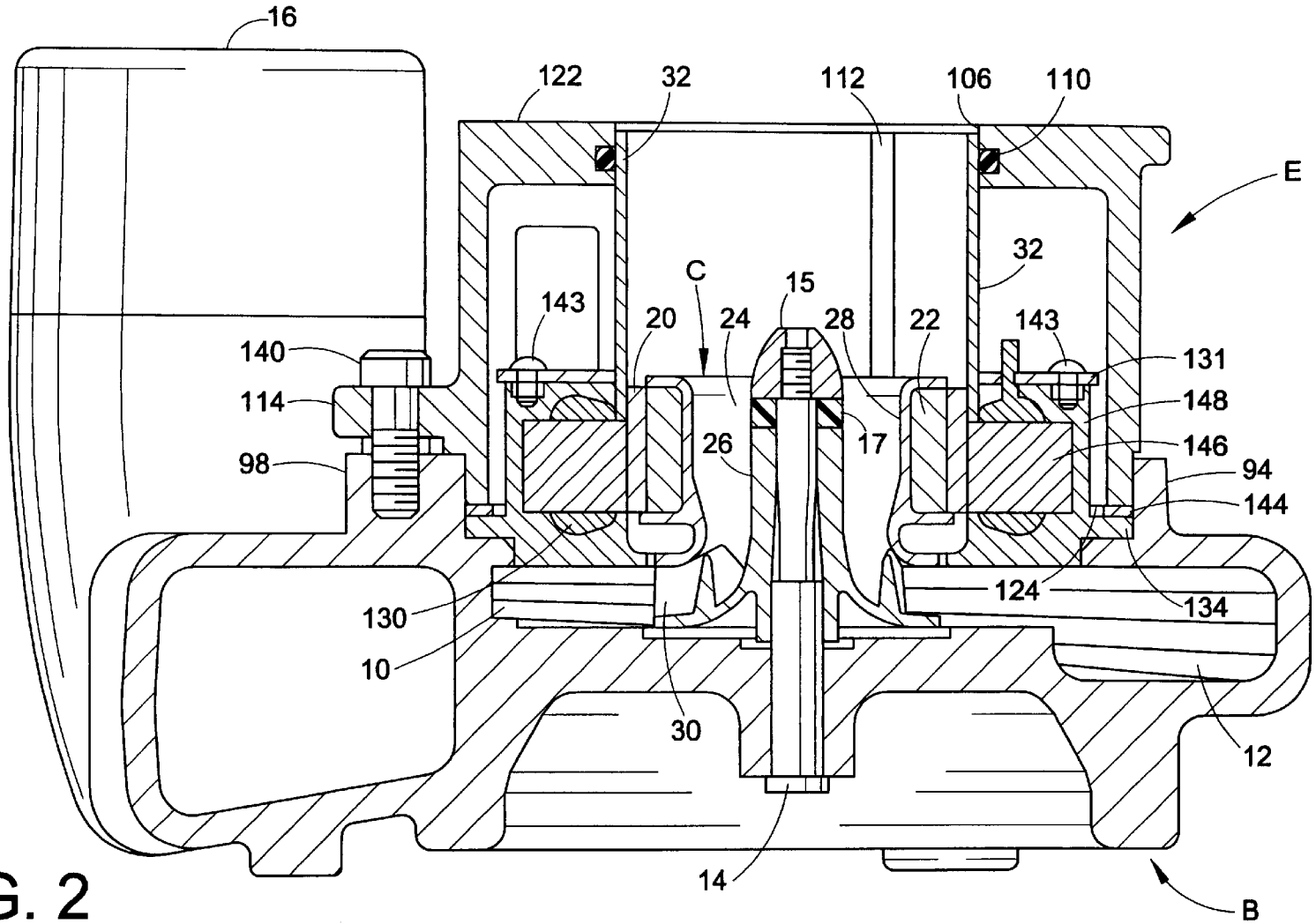
FIG. 2 is an enlarged cross-sectional elevational view of the motor, impeller and base of the pump assembly of FIG. 1.
Figure 3:
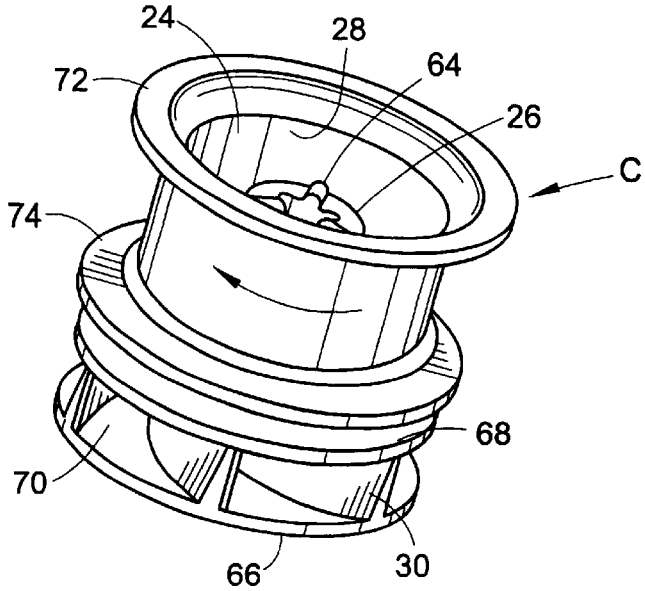
FIG. 3 is a perspective illustration of a pump impeller.
Figure 4:
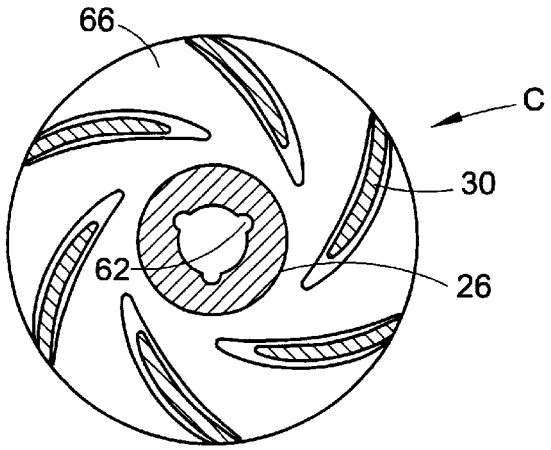
FIG. 4 is a cross-sectional elevational view of the pump impeller showing the impeller vanes.
Figure 5:
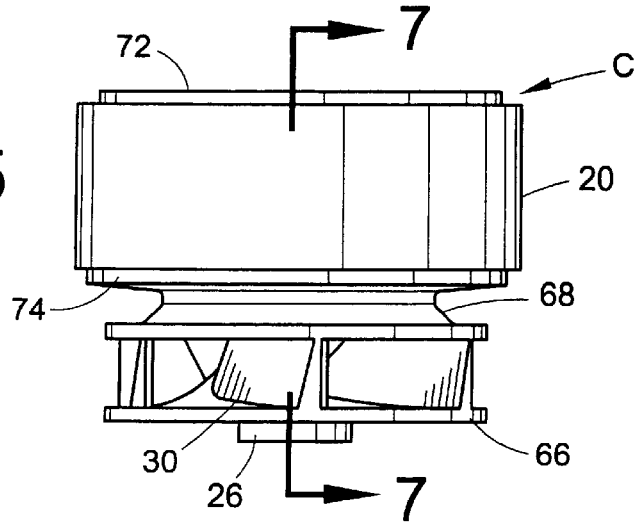
FIG. 5 is a side elevational view of the pump impeller having a permanent magnet motor rotor attached thereto.
Figure 6:
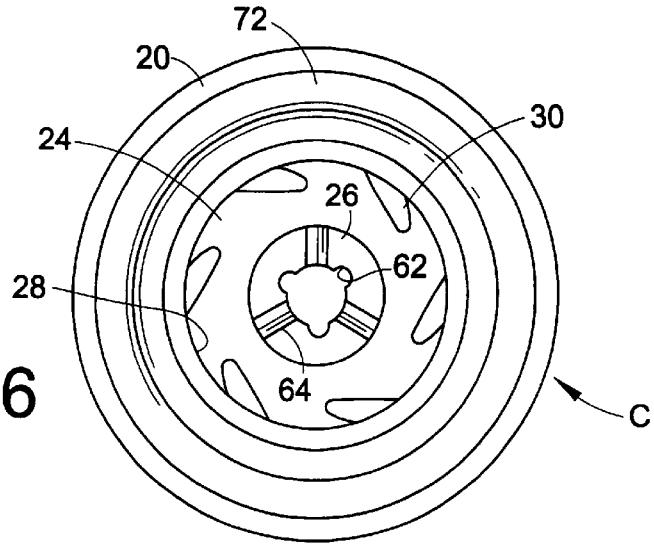
FIG. 6 is a top plan view thereof.
Figure 7:
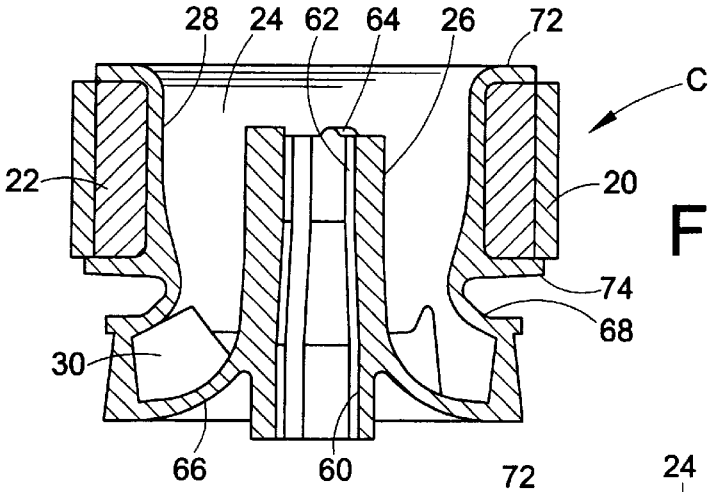
FIG. 7 is a cross-sectional elevational view taken generally on line 7—7 of FIG. 5.
Figure 8:
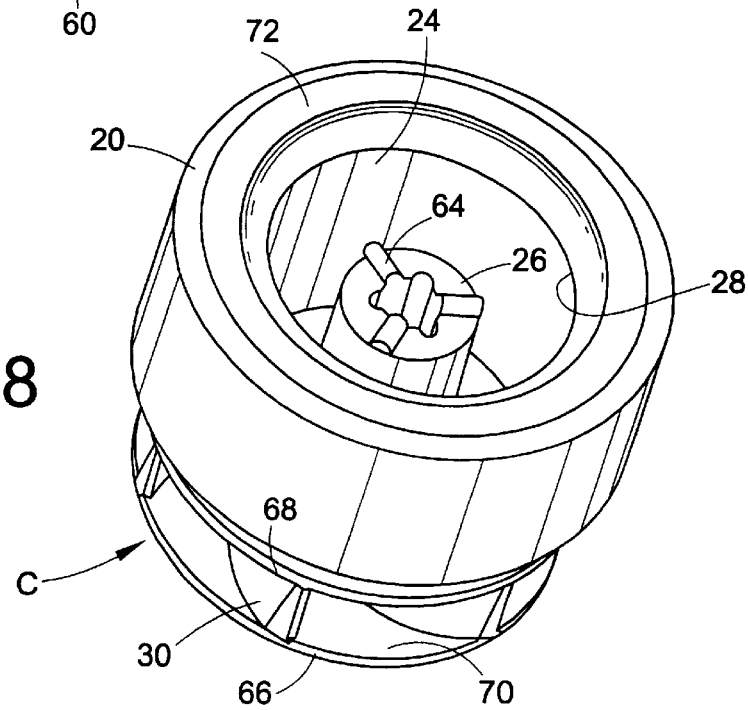
FIG. 8 is a perspective illustration thereof.

Referring now to FIGS. 3–8, impeller hub C has a central hole 60 therethrough for receiving shaft 14 of FIGS. 1 and 2 to provide rotation of impeller C on shaft 14. Impeller hole 60 has a plurality of circumferentially-spaced longitudinal grooves therein, only one of which is referenced by a numeral 62 in FIGS. 4, 6, 7 and 8, for lubrication flow and to allow flushing of debris. The top end of hub 26 has three circumferentially-spaced radially extending arcuate projections 64 thereon for reception in matching grooves in thrust bearing 17.

The bottom end portion of impeller hub 26 extends outwardly beneath vanes 30 to provide a hub bottom shroud 66. Impeller annular shroud 28 extends upwardly above impeller vanes 30, and includes an outwardly curved bottom portion 68 above vanes 30. Vanes 30 extend between hub bottom shroud 66 and bottom portion 68 of upper annular shroud 28 to provide a plurality of circumferentially-spaced impeller discharge outlets between the vanes, only one of such outlets being indicated by a numeral 70.

Impeller C preferably is molded of synthetic plastic material, and ring 22 of magnetic steel preferably is insert molded therewith between outwardly extending flanges 72, 74 that extend outwardly from impeller annular shroud 28. Permanent magnet motor ring 20 may be bonded to steel ring 22 with a suitable adhesive, such as epoxy.

Magnet ring 20 is radially magnetized with alternating north and south poles on the inner and outer peripheries thereof. Obviously, the polarity of the poles on the inner and outer peripheries is such that the poles of one polarity on the outer surface are radially aligned with poles of opposite polarity on the inner surface. For a four pole rotor, the magnet ring is radially magnetized to have four poles, each extending over 90° and alternating in polarity around the ring circumference. For an eight pole rotor, each pole extends over 45°. Magnetic flux exits the north poles on the outer periphery, and extends outwardly therefrom and then back toward the adjacent two south poles. Steel ring 22 provides a more efficient flux return path on the inner surface of the magnet ring and increases the strength of the magnet.

Figure 10:
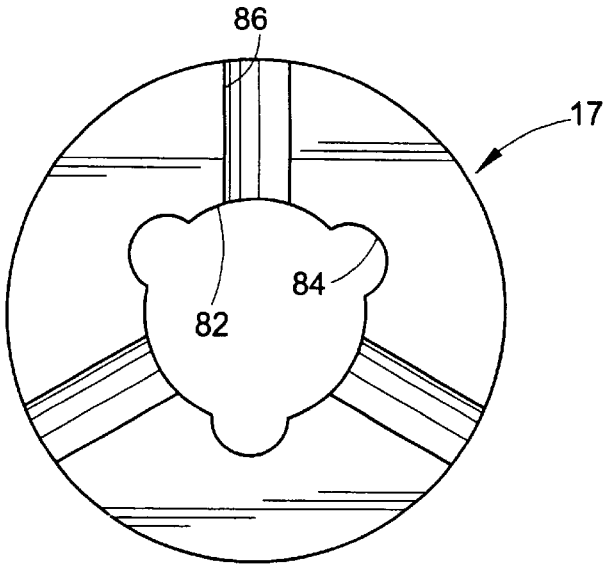
FIG. 10 is a top plan view thereof.
Figure 9:
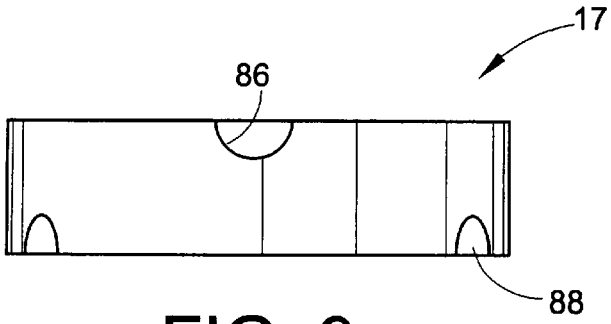
FIG. 9 is a side elevational view of a thrust bearing.
Figure 11:
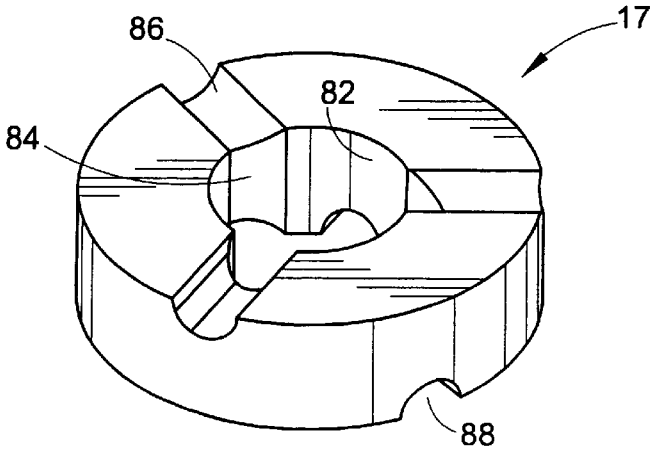
FIG. 11 is a perspective illustration thereof.

FIGS. 9–11 show generally cylindrical flat thrust bearing bushing 70 having a central hole 82 for closely receiving shaft 14. A plurality of longitudinal grooves 84 in the periphery of hole 82 allow flow of liquid therethrough for lubrication and flushing of debris. Three circumferentially-spaced radially extending arcuate grooves 86 are provided in one flat surface of bearing member 80 and corresponding grooves 88 are provided in the opposite flat surface rotatably displaced 60 degrees from grooves 86. Either grooves 86 or 88 are dimensioned, shaped and positioned for receiving projections 64 on the top end of impeller hub 26 so that bearing member 86 rotates with impeller C. The radial grooves in both the top and bottom flat surfaces of bearing member 80 permit installation thereof in either of inverted positions. The radial grooves that do not receive projections 64 on hub 26 allow flow of liquid radially between the bottom of nut 15 and the top surface of bearing bushing 17 for entering the vertical grooves in the inner peripheral surfaces of the bushing and the impeller hub for lubrication and for allowing flushing of any small particles.

Figure 12:
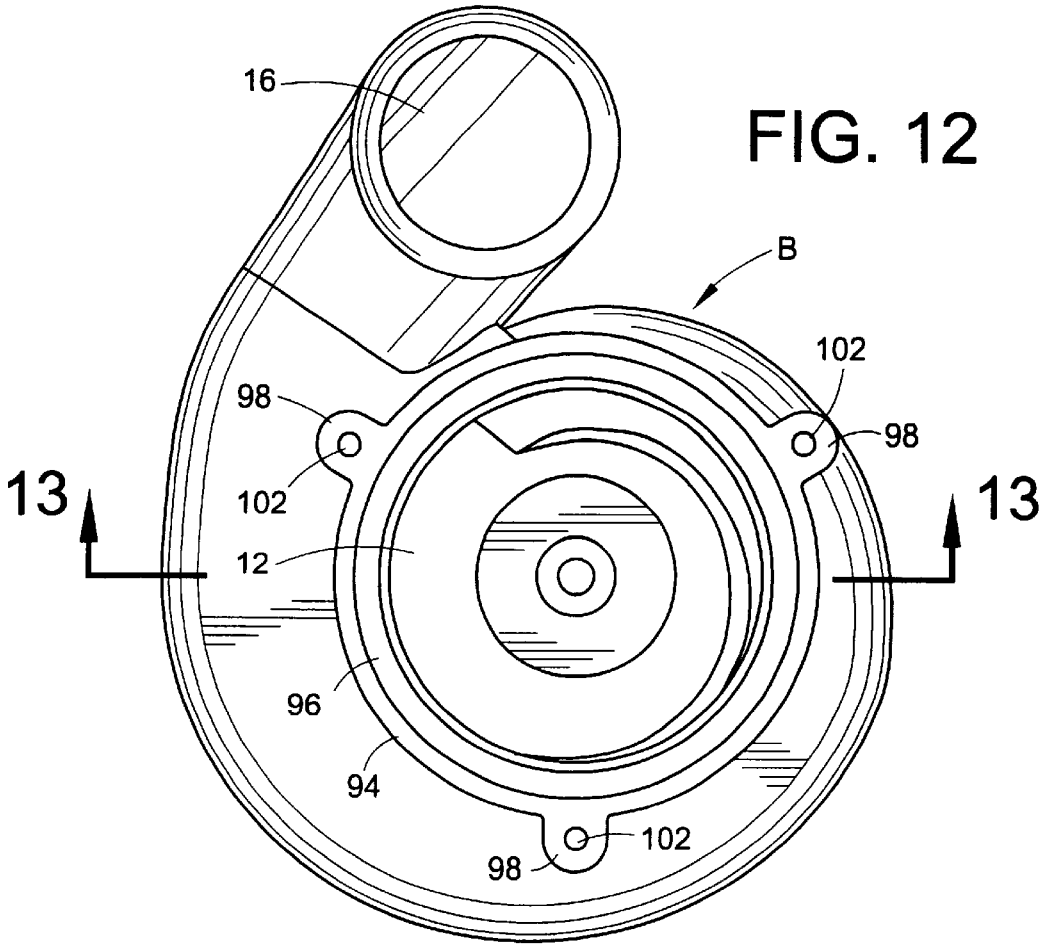
FIG. 12 is a top plan view of a pump base having a volute therein.
Figure 13:
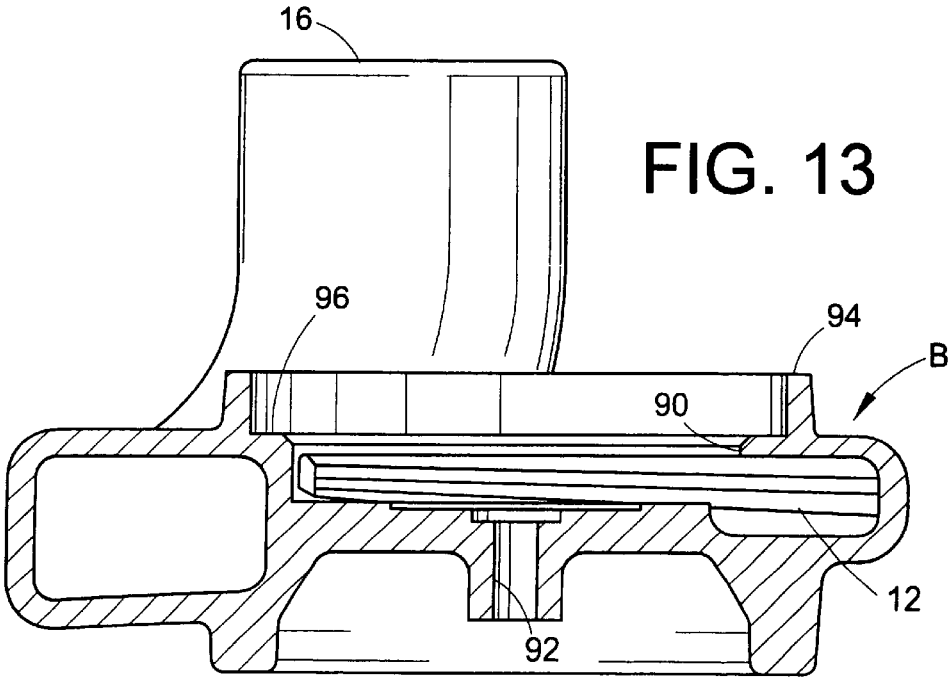
FIG. 13 is a cross-sectional elevational view taken generally on line 13—13 of FIG. 12.

FIGS. 12 and 13 show base B as having a circular top opening 90 to diffuse 10 for receiving the lower end portion of impeller C. Shaft receiving hole 92 for receiving the bottom end portion of shaft 14 of FIGS. 1 and 2 is concentric with circular impeller receiving hole 90. A circular flange 94 extends upwardly from base B in outwardly-spaced relationship to circular hole 90 to provide an annular horizontal shoulder 96 around hole 90. Three equidistantly spaced ears 98 extend outwardly from circular flange 94 and have tapped holes 102 therein for receiving bolts.

Figure 15:
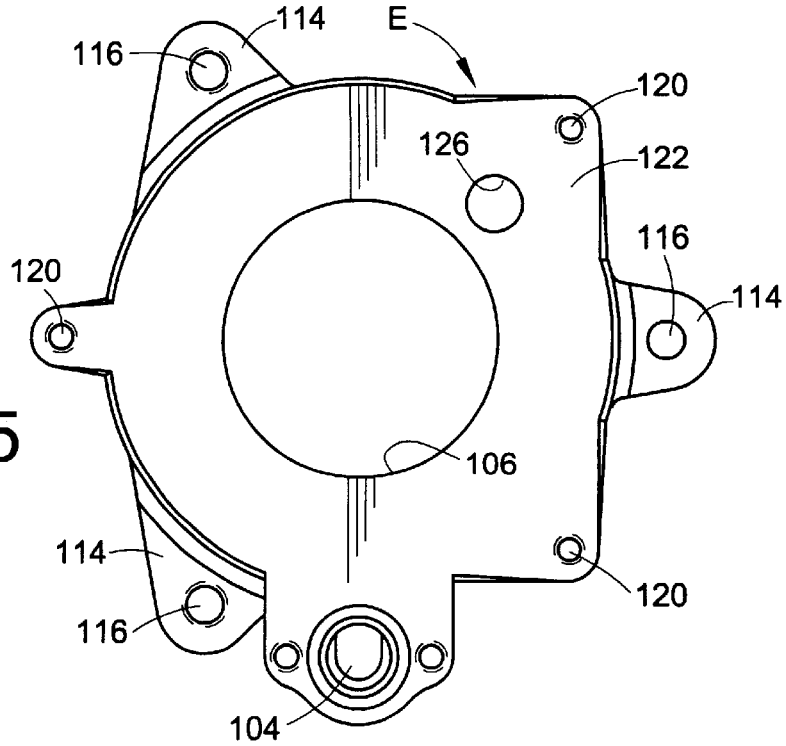
FIG. 15 is a top plan view thereof.
Figure 14:
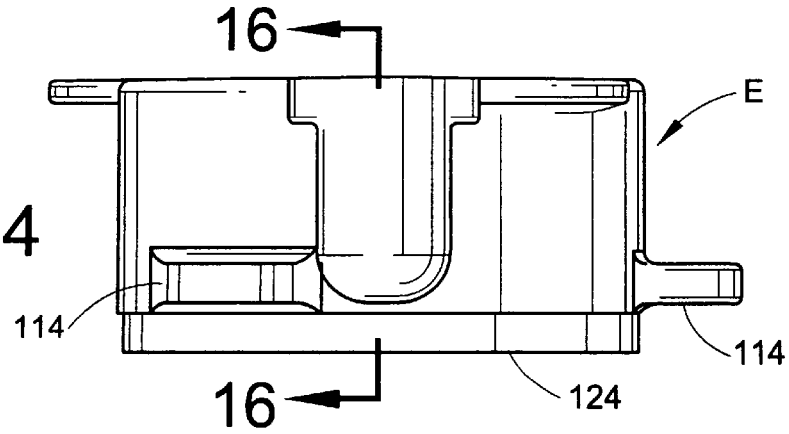
FIG. 14 is a side elevational view of a motor cover.
Figure 16:
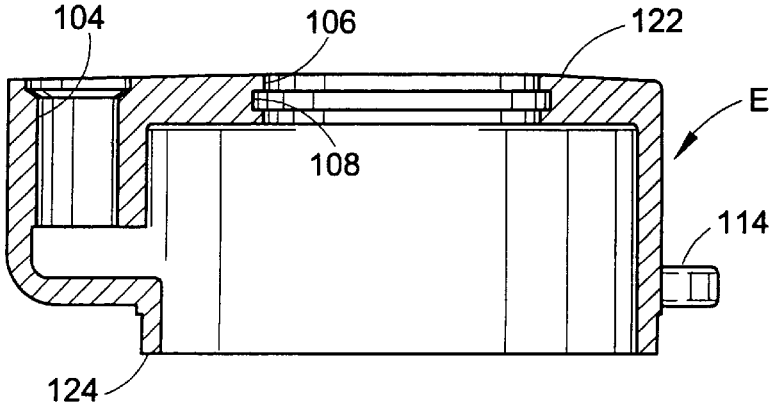
FIG. 16 is a cross-sectional elevational view taken generally on line 16—16 of FIG. 14.
Figure 17:
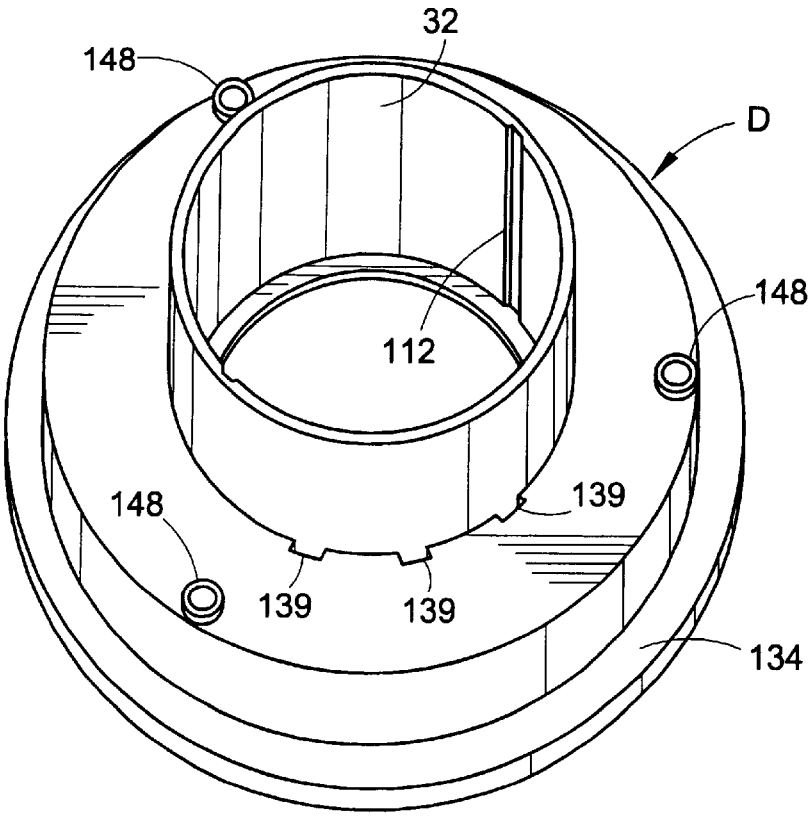
FIG. 17 is a perspective illustration of a permanent magnet motor stator.
Figure 18:
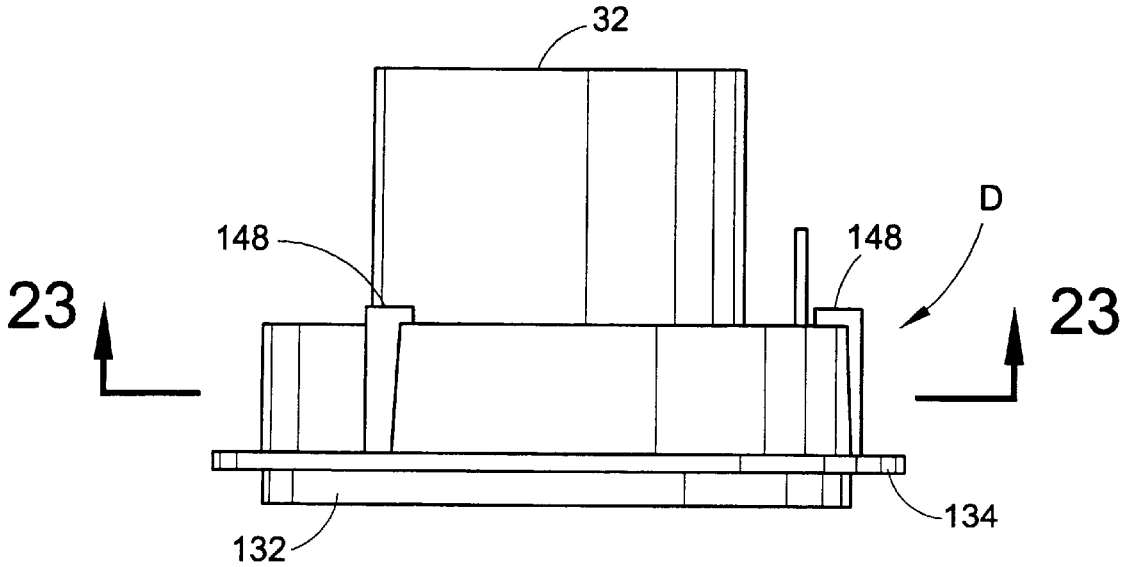
FIG. 18 is a side elevational view thereof.

FIGS. 14–16 show motor cover E having a passage 104 for receiving a power cord that supplies power to motor stator D. Motor cover E has a circular opening 106 for receiving integral sleeve 32 on the stator housing as shown in FIGS. 1 and 2. The peripheral wall of opening 106 has a circumferential groove 108 therein for receiving a sealing ring 110 that engages the outer peripheral surface of sleeve 32 as shown in FIGS. 1 and 2.

Figure 24:
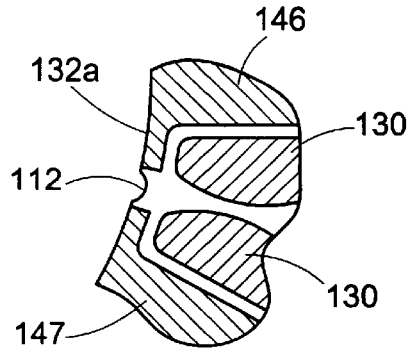
FIG. 24 is an enlarged detail of the circled area in FIG. 23.

The inner peripheral surface of stator housing sleeve 32 has a pair of opposite shallow vertical grooves 111, 112 therein. The outer periphery of the magnet motor ring 20 is in very close proximity to the inner peripheral surface of sleeve 32 to provide a very small clearance space, such as 0.001 inch, and the grooves 111, 112 allow flushing of any small particles that may enter the clearance space. As shown in FIG. 24, each groove 111, 112 is located between a pair of adjacent stator poles 146 so that the thickness of the plastic material 132*a* overlying the pole faces is not reduced.

Motor cover E has three circumferentially-spaced ears 114 extending outwardly therefrom with bolt-receiving holes 116 therethrough. Motor cover E also has three circumferentially-spaced tapped holes 120 therein for receiving the lower threaded end portions of the elongated bolts 40 of FIG. 1 that secure filter assembly F to motor cover E. Thus, the filter assembly rests against the upper surface 122 of motor cover E around opening 106 and inwardly of power cord opening 104. The bottom circular end 124 of motor cover E is adapted to bear against an outwardly extending flange on the plastic material housing of stator assembly D in FIGS. 1 and 2.

A tapped hole 126 in upper surface 122 of motor cover E receives a threaded bottom end on float assembly H for attaching the float assembly to the motor cover within the filter assembly.

FIGS. 17–24 show stator D as having a plurality of circumferentially-spaced stator coils 130 encapsulated in plastic material 132. An outwardly extending flange 134 is provided for clamping stator assembly D between base B and motor cover E as shown in FIGS. 1 and 2. Bolts 140 extend through the holes in ears 114 on motor cover E and thread into the tapped holes in ears 98 on base B to clamp stator flange 134 against base shoulder 96 with a suitable gasket 144 interposed between flange 134 and the bottom end 124 of motor cover E.

Figure 23:
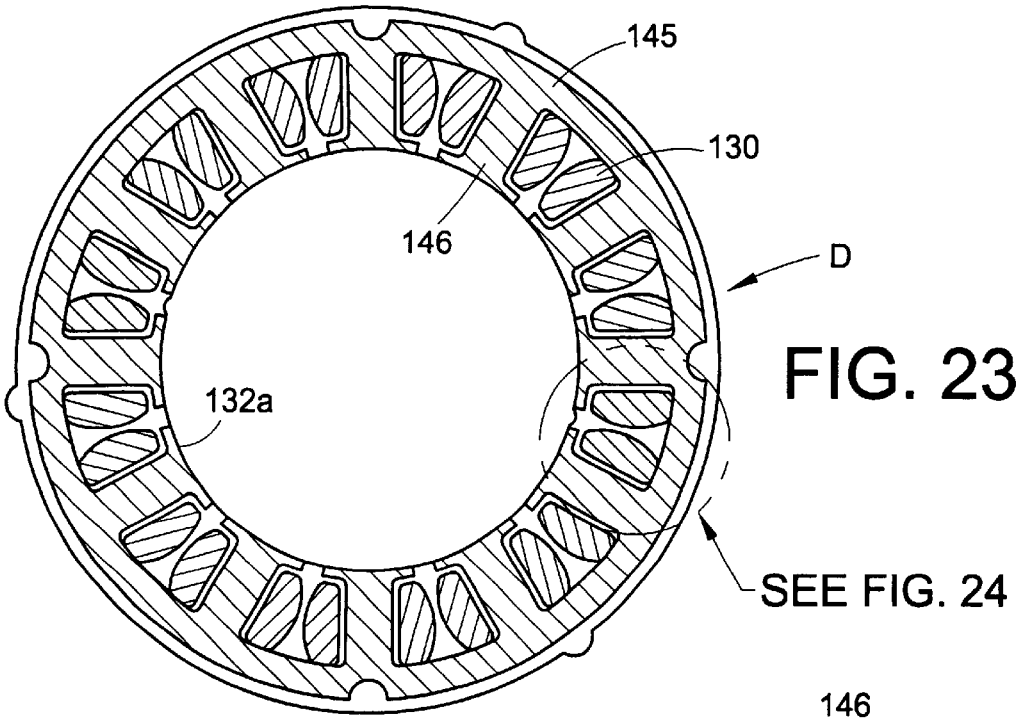
FIG. 23 is a cross-sectional plan view taken generally on line 23—23 of FIG. 18.

FIG. 23 shows motor stator laminations 145 having a plurality of circumferentially-spaced poles 146 with slots therebetween for receiving coils 130 in a known manner. The plastic material that overlies the inner peripheral surfaces of the poles is very thin as generally indicated at 132*a* in FIGS. 20–23. By way of example, plastic material 132*a* may have a minimum thickness of 0.018 inch. The plastic material 132*b* that overlies the coils 130 and extends outwardly from sleeve 32 likewise may be very thin.

As shown in FIGS. 19 and 22, three circumferentially-spaced posts 148 having screw receiving inserts 149 therein are molded integrally with the plastic material that forms the stator housing. The top ends of the posts extend above the stator coils as shown in FIG. 22 for supporting an annular printed circuit motor control board spaced above the stator coils.

Figure 25:
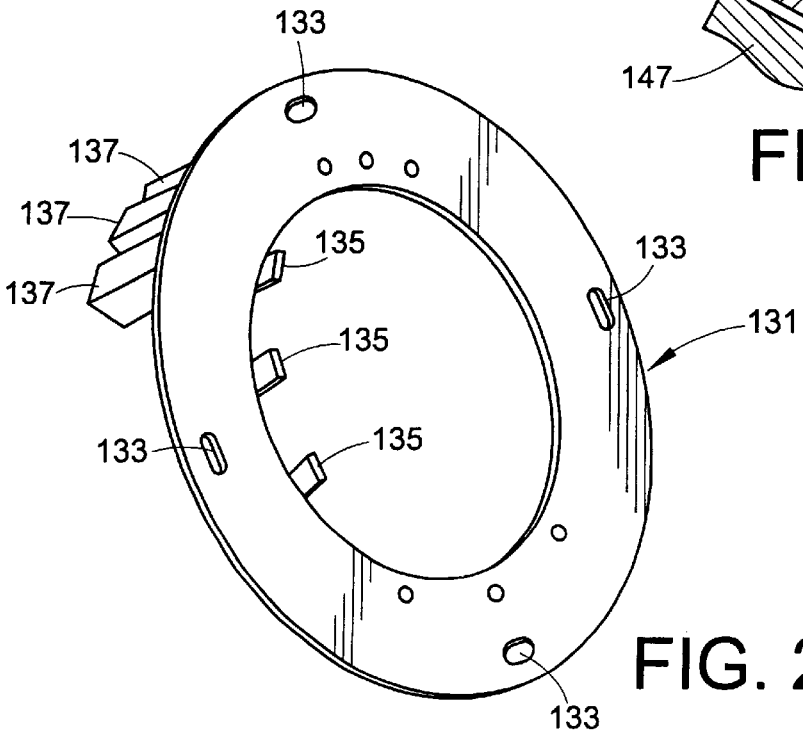
FIG. 25 is a perspective illustration of an annular printed circuit board motor controller that is attached to the stator assembly of FIGS. 17–24.
Figure 26:
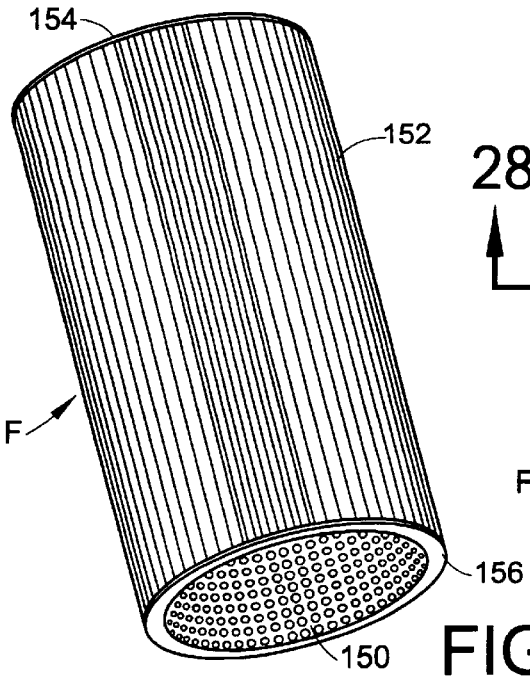
FIG. 26 is a perspective illustration of an inlet filter assembly.
Figure 27:
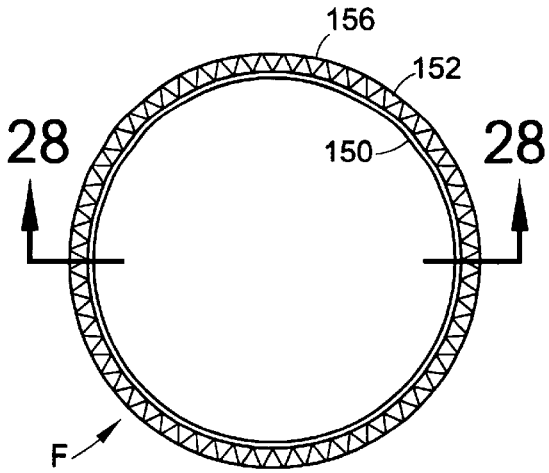
FIG. 27 is a top plan view thereof with the upper assembly ring removed for clarity of illustration.
Figure 28:
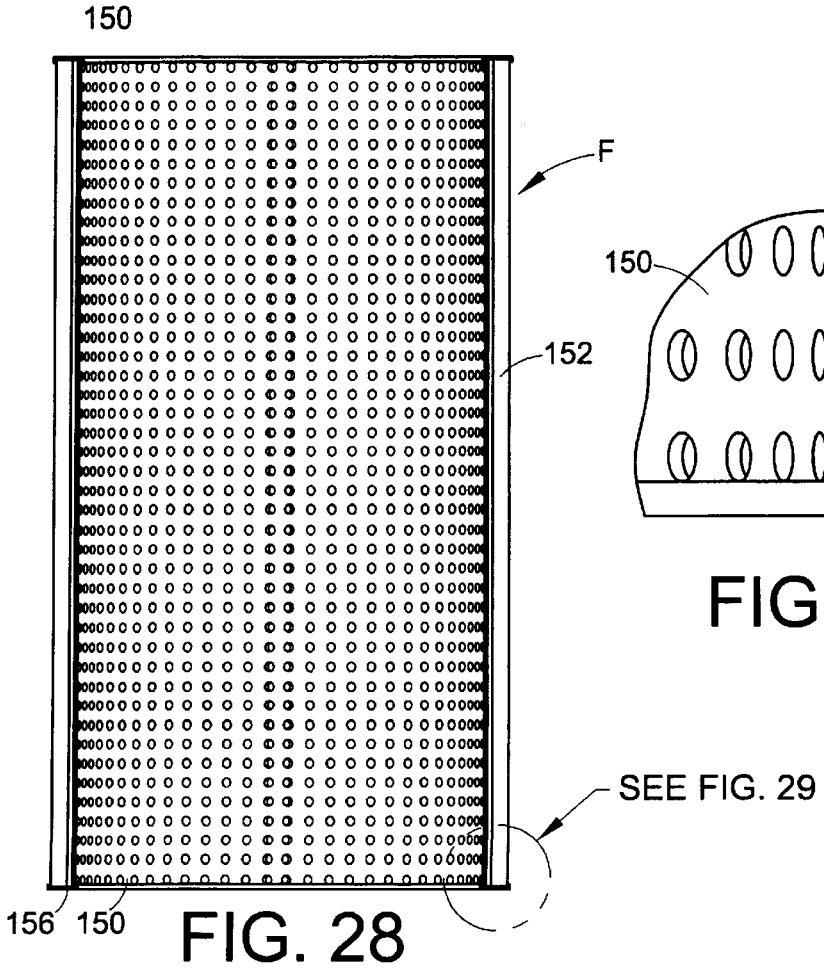
FIG. 28 is a cross-sectional elevational view thereof taken generally on line 21—21 of FIG. 20.
Figure 29:
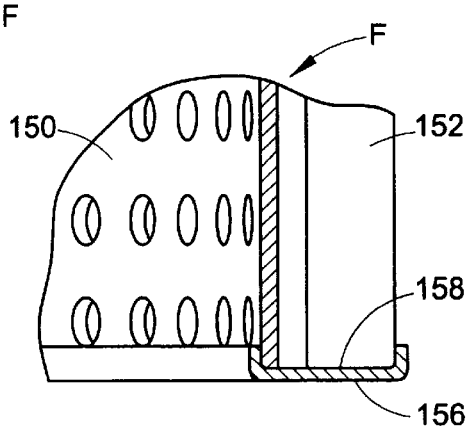
FIG. 29 is an enlarged cross-sectional detail taken on detail 21 of FIG. 20.

FIG. 25 shows a generally flat annular printed circuit board 131 having a plurality of circumferentially-spaced screw receiving slots 133 therein for receiving screws to secure board 131 to posts 148 on stator assembly D. Three spaced-apart Hall effect sensors 135 are attached to the inner periphery of board 131 so that they are located in very close proximity to and aligned with the upper end of permanent magnet motor ring 20 on impeller C for use in controlling current flow to the three-phase coil assembly on the stator for operating the motor. Three MOSFETS 137 extend from board 131 and are received in openings 139 of FIGS. 17 and 19 in the plastic material housing for stator D for controlling current to the stator coils. Circuitry on the printed circuit board, along with a microprocessor, responds to input from the float switches, Hall effect sensor, MOSFETS and other input controls to control operation of the brushless permanent magnet motor. The float switches are connected with the circuit board in a known manner.

Three spaced slot openings 141 in plastic material 132*b* are provided to connect the three motor leads for the three phase stator coils with the circuitry on printed circuit board 131. The printed circuit board 131 is secured to stator post 148 by screws 143 as best shown in FIG. 2.

FIGS. 26–29 show filter assembly F having a cylindrical perforate stainless steel sheet metal member 150 and an outer cylindrical eight mesh stainless steel screen 152 that is pleated or corrugated. Upper and lower rings 154, 156 have open channels 158 as indicated in FIG. 21 for receiving the top and bottom ends of the pleated screen and the sheet metal member. Sheet metal member 150 and eight mesh screen 152 may be secured within the ring channels by epoxy, welding or in any other suitable manner.

Cylindrical filter member 150 of 22 gauge stainless steel has a metal thickness of approximately 0.03 inch. Staggered holes of 0.25 inch diameter are provided throughout filter member 150 on staggered 0.312 inch centers. The pleats in eight mesh stainless steel screen 152 have a radial dimension of approximately 0.169 inch. That is, the distance from the outer surface of filter member 150 to the outer diameter of the pleated screen is approximately 0.169 inch. Obviously, other perforation sizes, mesh sizes and pleat sizes may be used.

FIG. 30 is a very diagrammatic illustration that provides an example of how the float switches may operate the brushless DC permanent magnet pump motor. Normally open upper and lower float switches 160, 162 are connected through a relay R with motor M. As water rises in the sump in which the pump is received, lower float switch 162 will close. As the water continues to rise, upper float switch 160 will close to energize motor M. Closing of upper float switch 160 also energizes relay R that closes normally open relay contact RC1. The motor then runs to discharge water from the sump. As the water falls below the upper float, upper float switch 160 will open but motor M will remain energized through relay contact RC1, lower float switch 162 and relay R. When the liquid level falls below the bottom float, lower float switch 162 will open to deenergize motor M. In a commercial embodiment, operation of the float switches is incorporated into the pump electronics and software to operate the pump motor.

FIG. 31 is a diagrammatic showing of a typical float operated reed switch wherein a reed switch 160 having a glass or other non-magnetic housing contains normally open reed contacts 162, 164. An annular permanent magnet 166 carried by float 54 closes reed contacts 162, 164 when float 54 moves upwardly. Subsequent downward movement of the float opens the switch. The upper float switch may operate in a similar manner.

In the arrangement of the present application, placement of the permanent magnet motor rotor on the inlet side of the impeller allows the outer periphery of the magnet to serve as a leakage control device. Providing a very small radial clearance of around 0.001 inch between the magnet rotor outer periphery and the inner surface of stator sleeve 32 significantly minimizes leakage of high pressure liquid back into the pump inlet and this enhances pump efficiency. Inlet liquid also flows axially through the center of the magnet rotor to the impeller vanes.

Figure 32:
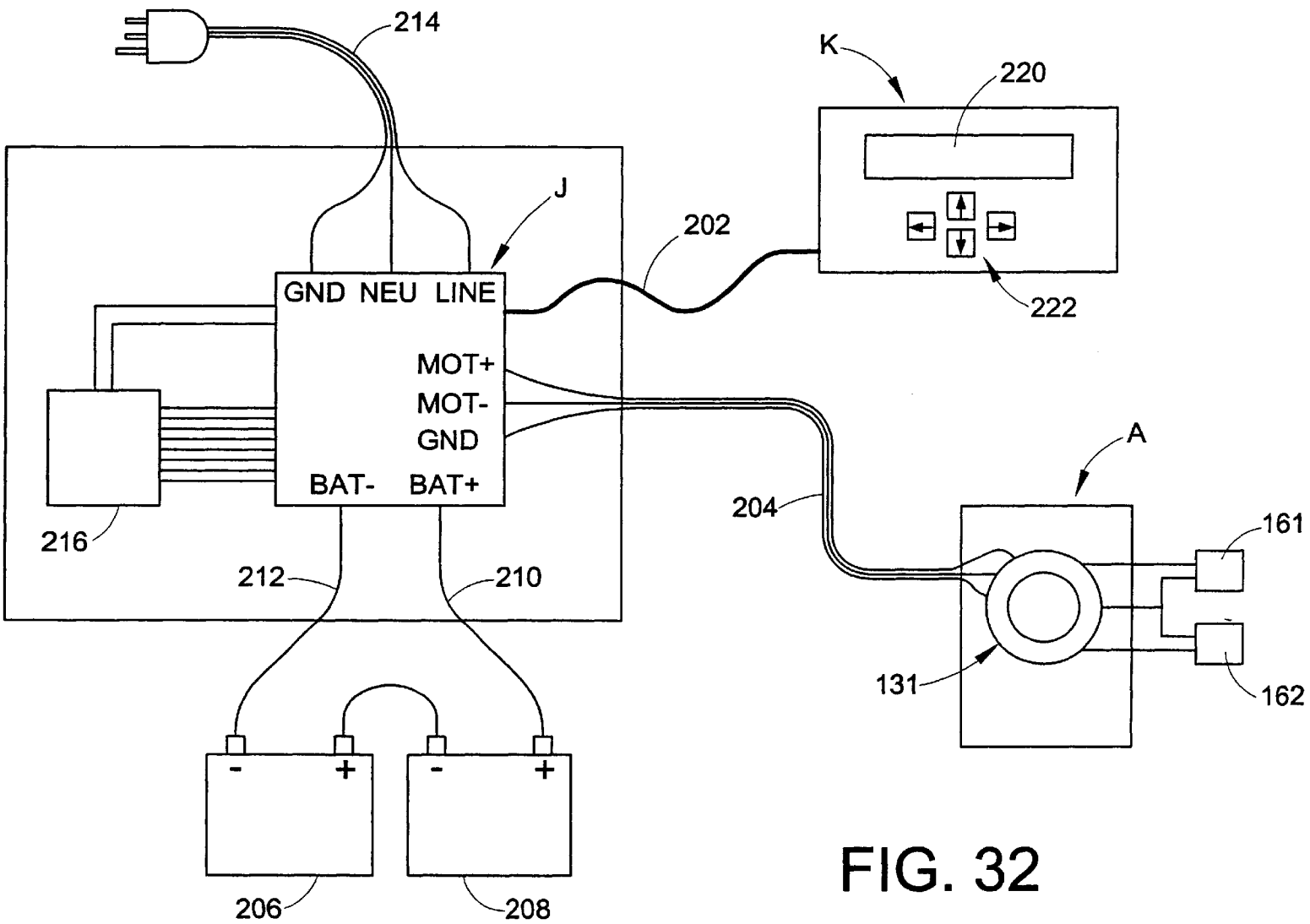
FIG. 32 is a block diagram of a control system in accordance with the present application.

The block diagram of FIG. 32 shows a system controller J attached by a four conductor cord 202 to a combined LCD and LED display, audible alarm and operator control panel K. It will be recognized that system controller J and panel K normally can be mounted in a common housing or in separate housings remote from one another. Each of system controller J, information display and control unit K, and motor controller 131 include a processor that is programmed to perform the functions described herein and to communicate with one another.

The control system of the present application monitors a plurality of different conditions for providing information signals to display unit K, and also operates the pump motor in different modes when certain conditions are sensed. If the motor is drawing high or normal amps while the speed is zero, the rotor is jammed, and visual and/or audible warnings are provided by display unit K. The motor temperature also may be monitored.

A condition with both floats floating and low current draw by the motor indicates that the pump inlet is clogged and the rotor is rotating in air. Visual and/or audible information about the condition is provided to display unit K. The motor also may be jogged by rapidly reversing it at high frequency to cause the motor assembly to shake and vibrate in an attempt to remove the clog.

A condition with the upper float floating and the lower float down indicates a stuck float. Visual and/or audible information about the condition is provided to display unit K. The motor also is jogged by rapidly reversing it at high frequency to shake and vibrate the pump assembly in an attempt to free the stuck float.

When the pump is running for longer than around ten seconds and the upper float is still floating while speed and amps are normal, the pump automatically goes into a higher speed turbo mode in an attempt to deal with the excess water. Visual and/or audible information of this condition is provided to the display unit.

PC board and motor controller 131 of FIG. 25 is part of pump assembly A and is connected with system controller J by way of a three conductor cord 204. The system controller and the PC board communicate with one another by way of the ground wire. Upper and lower float switches are connected with the electronics on motor controller 131. A pair of series connected 12 volt batteries 206, 208 are connected by positive and negative leads 210, 212 with system controller J. A power cord 214 attached to system controller J connects to 120 volts AC, and a transformer 216 that is part of the system controller converts the power to DC. LCD/LED display, alarm and operator control panel K includes an LCD/LED readout 220 in which information signals are displayed, and a plurality of push buttons 222 for manipulation by an operator to manually control the pump and the control system. Display K also includes an audible alarm for sounding audible warnings under selected pump conditions.

System controller J provides DC power to the pump motor by way of 120V AC, 12V DC, or 24V DC; charges, maintains and monitors one or two 12 volt lead acid backup batteries; conducts system diagnostics automatically and on demand; and communicates with the end user by way of a backlit LCD display, a tri-color LED and an audible alarm.

System controller J includes a processor that is programmed to automatically determine and indicate the condition of the pump system, and to automatically perform a plurality of different diagnostic and operational functions as described hereafter.

The pump system is operable on 120 volts AC, or from either a 12 volt or 24 volt DC battery supply. System controller J automatically senses battery voltage and configures itself to operate on either 12 volts DC or 24 volts DC when AC power is not available. A tricolor LED in display K tells a user whether the pump system is ready to operate.

System controller J charges and maintains batteries 206, 208; provides power to motor controller 131; communicates with a user by way of a backlit LCD 220; and performs system diagnostics.

The LED displays green to indicate that the system is ready, flashing yellow to indicate that the pump system will still operate but requires attention, and flashing red to indicate that the system is inoperable. The displayed information is based on the last available system test rather than battery voltage.

The system controller will recharge and maintain either a 12 volt DC battery or a 24 volt DC dual battery arrangement. The system controller monitors float current, and provides visual information on display K when the current per battery exceeds one amp, thereby indicating the need for battery replacement.

On a daily basis, the system controller conducts a low speed battery exercise and pump test as long as the lower float is floating. Audible and LED warnings are activated if a problem is encountered.

A toggle switch is provided to switch the display between a status menu and a warning menu. A manually operable pushbutton is useable to test the pump system at low speed provided sufficient water is present for the test to begin. Audible and visual warning signals are activated to warn of possible pump damage if the lower float is not floating. A manual reset button selectively resets the controller to factory settings.

When the pump operates for more than ten seconds and the upper float switch is still closed, the system controller automatically ramps the pump motor to higher speed and displays an LCD message indicating high speed operation is activated. If the pump discharge line is clogged, the additional pressure may relieve the obstruction.

The status menu provides a plurality of messages to a user on display K as follows: the percent full charge based on battery voltage indicates 100% when 12 volt terminal voltage is 13.0 or greater or when 24 volt terminal voltage is 26.0 or grater, and indicates 0% when 12 volt terminal voltage is 10.5 or less or when 24 volt terminal voltage is 21.5 or less; indicates when battery is charging; indicates time since completion of last system test; indicates AC power status, i.e., available or failure; indicates high speed mode is activated when pump has been running for more than 10 seconds and the upper float is still floating; indicates that the system is available for a manual test when the lower float is floating; indicates that water is required to perform a self test when a request has been made for a manual or a self test and the lower float is not floating; indicates when an automatic self test is started; and indicates when an automatic self test is completed.

A warning menu, when one is provided in the system, displays warnings on display K as follows: AC power failure—which automatically is removed if/when AC power is restored; check battery connections/polarity; back up power activated—for other than a test; pumping capacity exceeded—when the pump is operating for more than 10 seconds in the high speed mode and the upper float is still floating; jammed—when both floats are floating and power is available but the rotor is locked and cannot be freed by jogging; self cleaning activated—to jog/shake the pump system; control box or connection failure—when there is insufficient voltage from the power supply to operate the pump; clogged filter—when both floats are floating and power is available but speed is very high and amps are very low, thereby indicating that the impeller is spinning in air; replace battery—when the charger has been operating for twenty four hours or more and the battery is still drawing a current in excess of one amp; low battery charge—when battery terminal voltage drops below 10.5 volts DC for a 12 volt system or below 21 volts DC for a 24 volt system; fuse failed; pump failure; and float stuck—when the upper float is floating but the lower float is not floating which is an impossible situation unless the pump is upside down and therefore indicates a stuck float.

A piezoelectric audible alarm provides different sounds for different conditions as follows: continuous chirp—low battery; set of triple tones every hour—loss of AC power; one three-second tone—pump operating on battery; loud high/low warble—pump cannot keep up; and continuous tone—wrong battery polarity.

The LED provides different displays as follows: green indicates that the system is ready, battery is charged, amps required to maintain battery are low, AC power is available, and there are no active warnings or alarms; flashing yellow indicates that the system will function but needs attention such as when the motor jog sequence was initiated, battery voltage is low, AC power is out, or high speed turbo mode has been activated; flashing red indicates that the system will not function for any of several reasons such as battery terminals reversed, rotor jammed, float switch stuck, clogged filter, battery exhausted, blown fuse, pump failure, pump capacity exceeded, control box or connection failure, and battery needs replacement.

Figure 33:
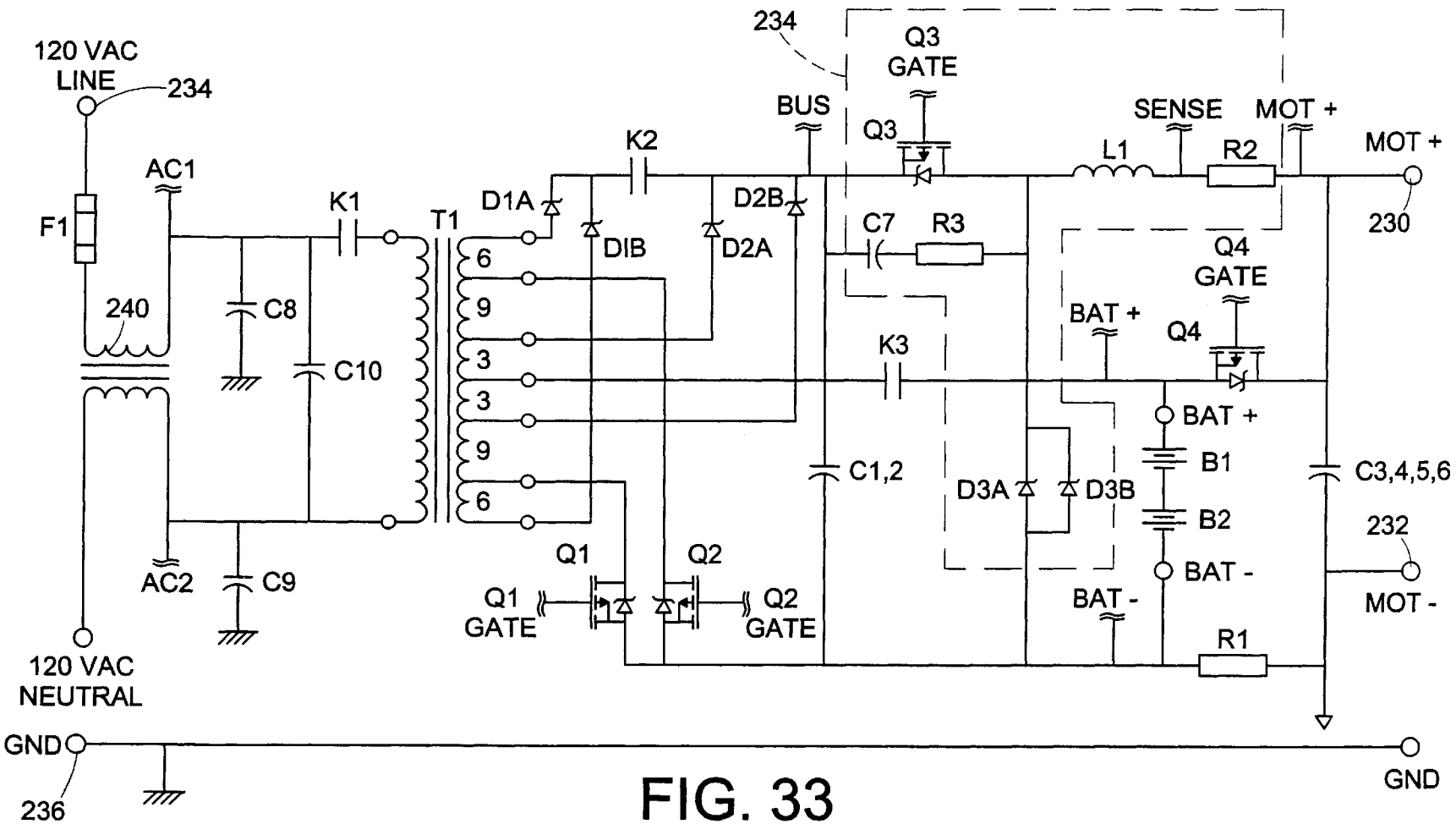
FIG. 33 is a circuit diagram of the power supply for operating the pump motor on rectified AC power or on battery power.

FIG. 33 shows a power supply circuit for supplying power to pump motor terminals 230, 232 from a 120 volt AC power supply 234, 236 or from one or two twelve volt batteries B1, B2. A common mode choke 240 together with capacitors C8, C9 and C10 provide suppression of electrical noise. Isolation transformer T1 steps down 120 volts AC to 40 volts DC and also doubles as a step up transformer for battery power. Normally closed relay K1 opens when battery power is used to disconnect transformer T1 from the AC power source.

A variable buck regulator 243 steps down 36 volts DC to the voltage required to run the pump motor or to charge the batteries. The components of the buck regulator are MOSFET Q3, coil L1, resistor R2, resistor R3, capacitor C7, recirculating diodes D3*a*, D3*b* that allow current when Q3 is off, and capacitors C3, 4, 5, 6. MOSFET Q4 allows the battery to be disconnected from the system to run at different voltages. Q4 is on when the battery is charging and when the motor is operating directly from a 24 volt battery power supply. At other times, Q4 is off.

MOSFETS Q1, Q2 and normally open relay contact K3 define an inverter circuit for battery power. Relay contact K3 closes when the inverter is running to provide a 50% duty cycle so that the battery voltage is seen as an AC voltage across the transformer windings. For a one battery system, Q4 remains off, K3 closes, and Q1 and Q2 are alternately turned on for a 50% duty cycle. This forces current into the secondary of transformer T1 to step up the battery voltage. At the same time, K2 is closed, and D1*a* and D1*b* are active. K1 remains open whenever AC is not present to disconnect the transformer from the AC power source.

When the upper float switch remains floating for a predetermined time, such as around 10 seconds or more, the system controller supplies 30 volts DC to the pump motor for high speed turbo operation. When AC is present, the 40 volts DC bus is simply regulated down to 30 volts DC for high speed turbo operation. If the system is running on one battery, the battery voltage is boosted from 12 volts DC to 30 volts DC using Q1, Q2, D1*a*, D1*b*,K2 and T1. If running on two batteries, voltage is boosted to 30 volts DC using Q1, Q2, D2*a*, D2*b* and T1.

Resistor R1 is a current sensing resistor that measures motor current. C1 is a filter capacitor that filters rectified AC voltage when operating on AC power. Relay contact K2 is a voltage selection relay contact for operating on a single 12 volt battery or on two series connected twelve volt batteries that supply 24 volts. When there is a single 12 volt battery, relay contact K2 closes to provide a higher step up voltage to 24 volts. The microprocessor is programmed for controlling the circuit of FIG. 33 to supply 14 volts for charging a single battery and 28 volts for charging a dual battery system. The processor provides 24 volts DC for normal running of the pump motor and 30 volts DC for high speed turbo operation of the pump motor.

Figure 34:
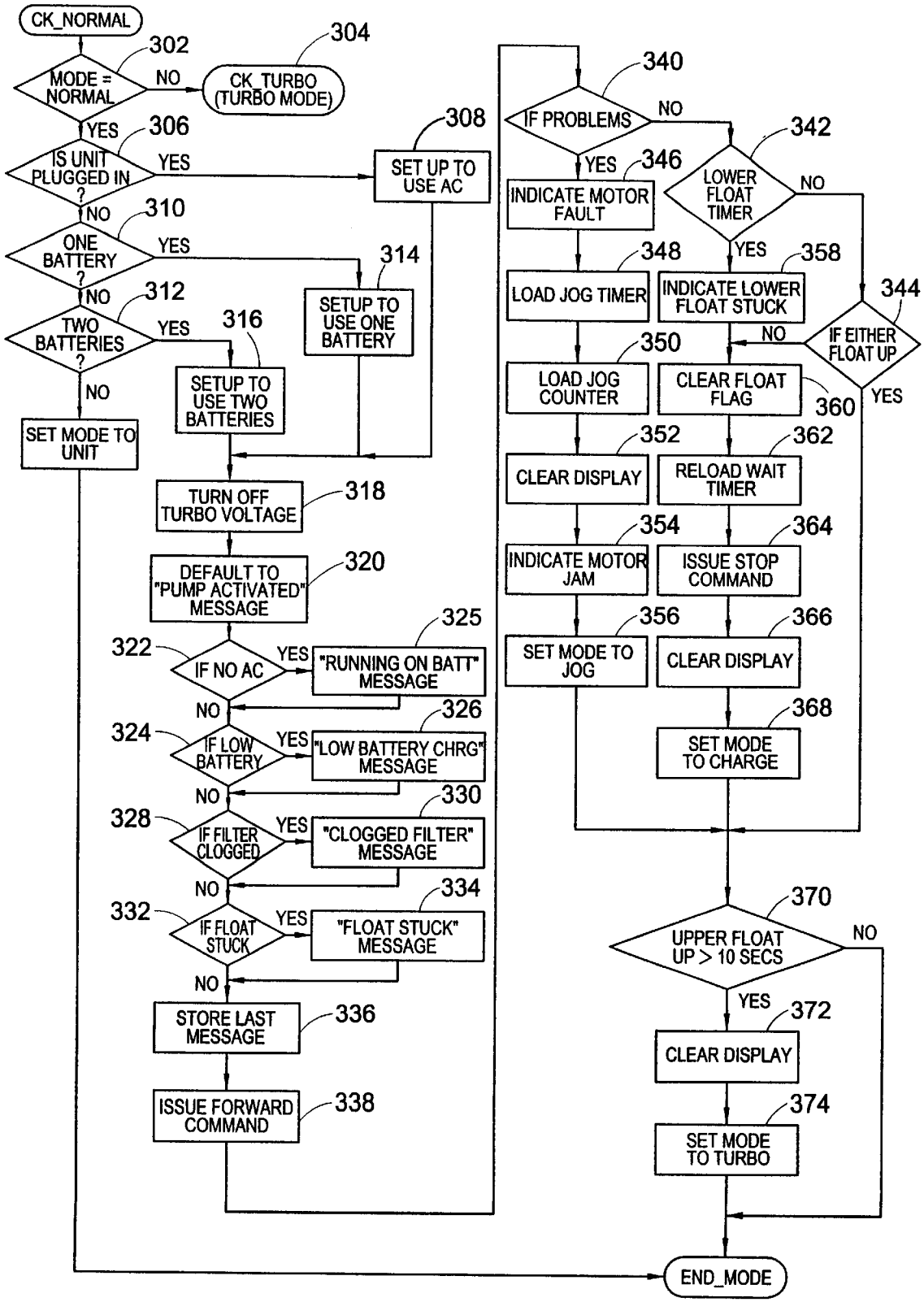
FIG. 34 is a flow chart of the operation of the pump control system in a normal run condition.

FIG. 34 shows the operation of the pump system in a normal operating mode. With both floats floating and calling for operation of the pump, the system checks for the normal mode of operation as indicated at 302. If the mode is not normal, the system checks for high speed turbo mode 304. If the mode is normal, the system checks for the availability of AC power at 306. If AC power is available, the system sets up to run on AC power at 308.

If there is no AC power available, the system checks for one battery at 310 or two batteries at 312. If one battery, the system sets up to use one battery at 314. If there are two batteries, the system sets up to use two batteries as indicated at 316. The system then checks to be sure that the high speed turbo voltage is off at 318. A pump activated message at 320 is sent to information display unit K of FIG. 32. If there is no alternating current available 322, a running on battery message 325 is displayed on display unit K. If the battery is low 324, a low battery charge message 326 is displayed on display unit K. With both floats floating but low current draw by the motor while running at normal speed, the system senses a clogged inlet 328 and displays a message 330 on display unit K to indicate a clogged filter. If the upper float is floating, but the lower float is not, the system senses a stuck float 332 and sends a corresponding message 334 to display unit K. The last message is stored 336 and a forward command is issued 338.

The system then checks whether problems have been indicated 340. If there are no problems, the system checks whether the lower float has been floating for longer than a predetermined set time at 342. If the lower float floating timer has not expired, the system checks whether either the top or the bottom float is floating at 344.

If problems were sensed at 340, a motor fault is indicated 346. The jog timer 348 then is loaded along with the jog counter 350. The display is cleared 352 and a motor jam condition 354 is displayed on display unit K. The operating mode is then set to jog 356 for rapidly reversing at high frequency the direction of motor rotation for vibrating and shaking the pump assembly in an attempt to remove a clog or free a stuck float.

If the lower float timer at 342 indicates a stuck lower float, a message 358 is sent to display unit K. If neither float is up at 344, the float flag is cleared 360 and the wait timer is reloaded 362 while a stop command 364 is issued. The display then is cleared 366 and the system is set to charge the batteries 368. If the upper float remains up with the motor running longer than around 10 seconds 370, the display is cleared 372 and the system is set at 374 to run in high speed turbo mode. If the upper float has not been up longer than ten seconds at 370, steps 372, 374 are bypassed to end the run cycle.

Figure 35:
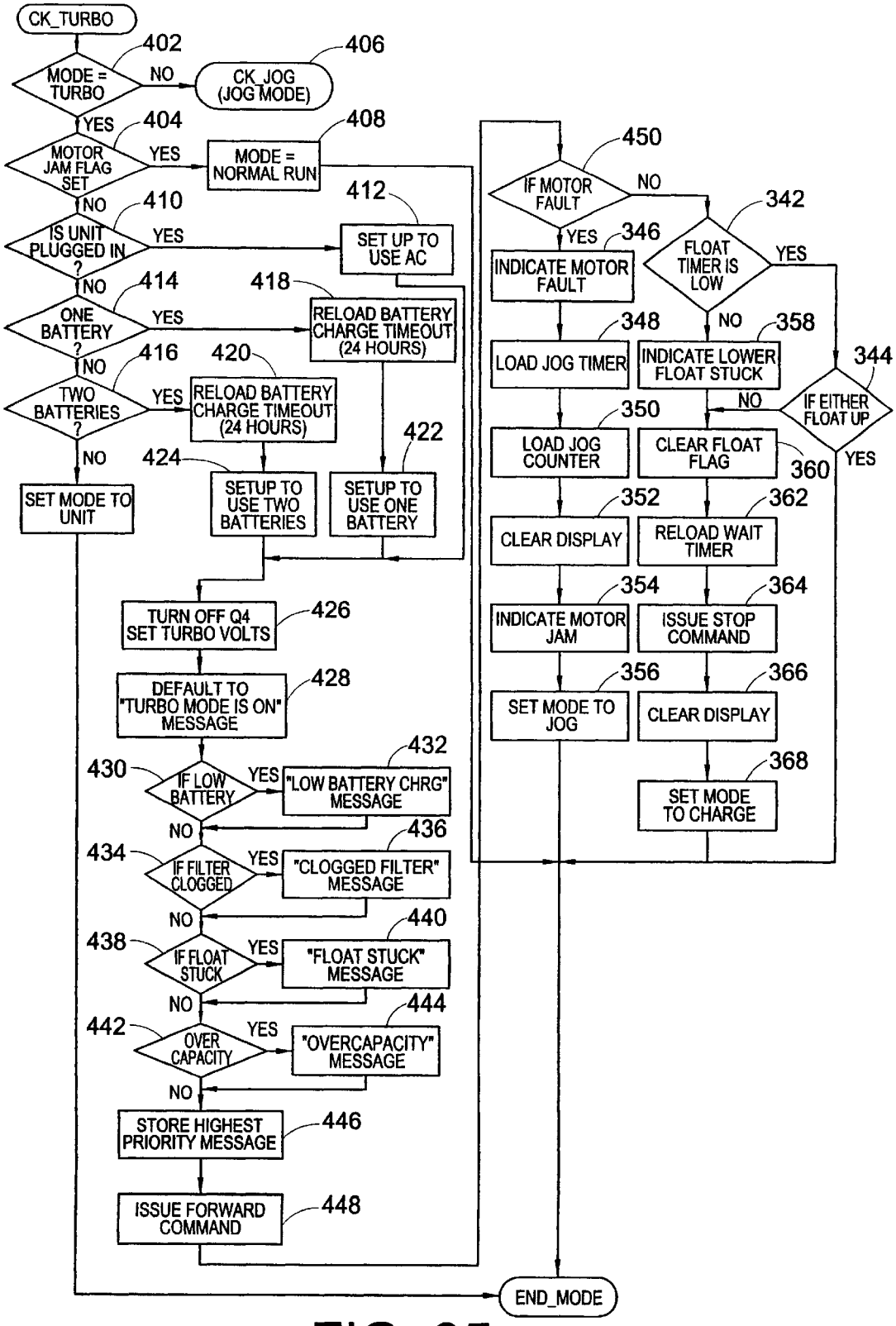
FIG. 35 is a flow chart of the operation of the pump control system in a high speed turbo run condition.

FIG. 35 shows the operation when the system has initiated a high speed turbo run mode in response to both floats floating and the upper float has been floating longer than around ten seconds. The system checks for the high speed turbo mode 402, 404 and will default to a jog mode 406 or a normal run mode 408. With the system set for high speed turbo operation, the system checks whether AC power is available 410. If so, the system sets up to use AC power 412.

If there is no AC power available, the system checks whether there is one battery 414 or two batteries 416. Depending on whether there is one or two batteries, the system reloads the 24 hour charge timeout 418, 420 and sets up to use one battery 422 or two batteries 424. If the system will operate on battery power, MOSFAT Q4 of FIG. 33 is turned off at 426 for supplying the higher speed turbo voltage to the motor. The high speed turbo mode message 428 is sent to display unit K.

If the battery is low 430, a corresponding message 432 is sent to display unit K. If the filter is clogged 434, a corresponding message 436 is sent to display unit K. If the float is stuck 438, a corresponding message 440 is sent to display unit K. If the upper float remains floating for a predetermined set time with the motor running in high speed turbo mode, an over capacity or flooding condition 442 is sensed and a corresponding message 444 is sent to display unit K. The highest priority message is stored 446 and a forward command 448 is sent. The system checks for any motor fault 450 and repeats the operations described with respect to FIG. 34.

Figure 36:
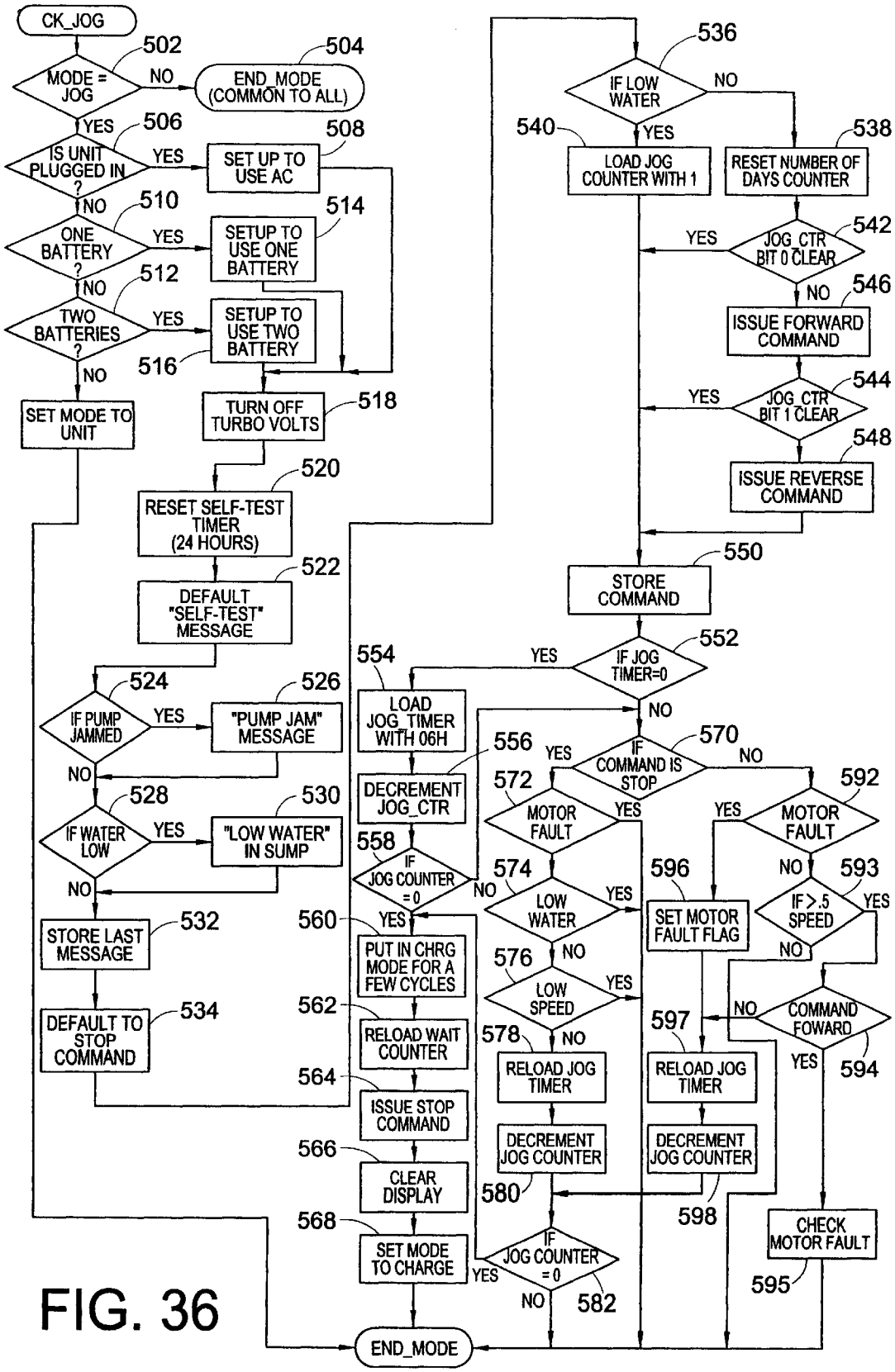
FIG. 36 is a flow chart of the operation of the pump control system in a jog run condition in which the motor is rapidly reversed at high frequency to shake and vibrate the pump system for freeing a stuck float or dislodging a clog.

FIG. 36 shows the operation in a jog mode for shaking and vibrating the pump assembly to dislodge a clog or free a stuck float by rapidly reversing the motor at high frequency. The system checks the jog mode 502 and defaults to the end mode 504. When the jog mode is called for, the system checks for availability of AC power 506 and sets up to use AC power 508 if it is available. If AC power is not available, the system checks for one or two batteries 510, 512 and sets up to use one battery 514 or two 516. The system checks to be sure that high speed turbo voltage is off 518 and turns it off if necessary. The 24 hour self test timer is reset 520 and the self test message 522 is displayed on display unit K. If the pump is jammed 524, that message 526 is displayed on display unit K. If water is low 528, a corresponding message 530 is displayed on display unit K. The last message is stored 532 and the system defaults to a stop command 534.

The system checks for low water 536 and resets the day counter 538 or loads the jog counter 540. The system checks whether the jog counter is clear 542, 544 and issues forward and reverse commands 546, 548 if the jog counter is not clear. If the jog counter is clear, the system reverts to store the commands at 550. If the jog timer 552 is at zero, the jog timer is loaded 554 to decrement the counter 556. If the jog counter is zero 558, the system is put in the charging mode 560 followed by reloading the wait counter 562. The stop command 564 is issued and the display is cleared 566 and the mode is set to battery charge 568.

If the jog timer is not zero at 552, the system checks for a stop command 570. If there is a stop command, the system checks for a motor fault 572 for low water 574, and for low speed operation of the motor 576. If all of these checks are no, the jog timer is reloaded 578 and the jog counter is decremented 580 until it reaches zero 582.

If there is no stop command at 570, the system checks for a motor fault 592. The system checks whether the motor is running at greater than half speed 593. If so, a forward command is issued 594 and the motor fault indication is cleared 595. If there is a motor fault, the motor fault flag is set 596, the jog timer is reloaded 597 and decremented 598.

Figure 37:
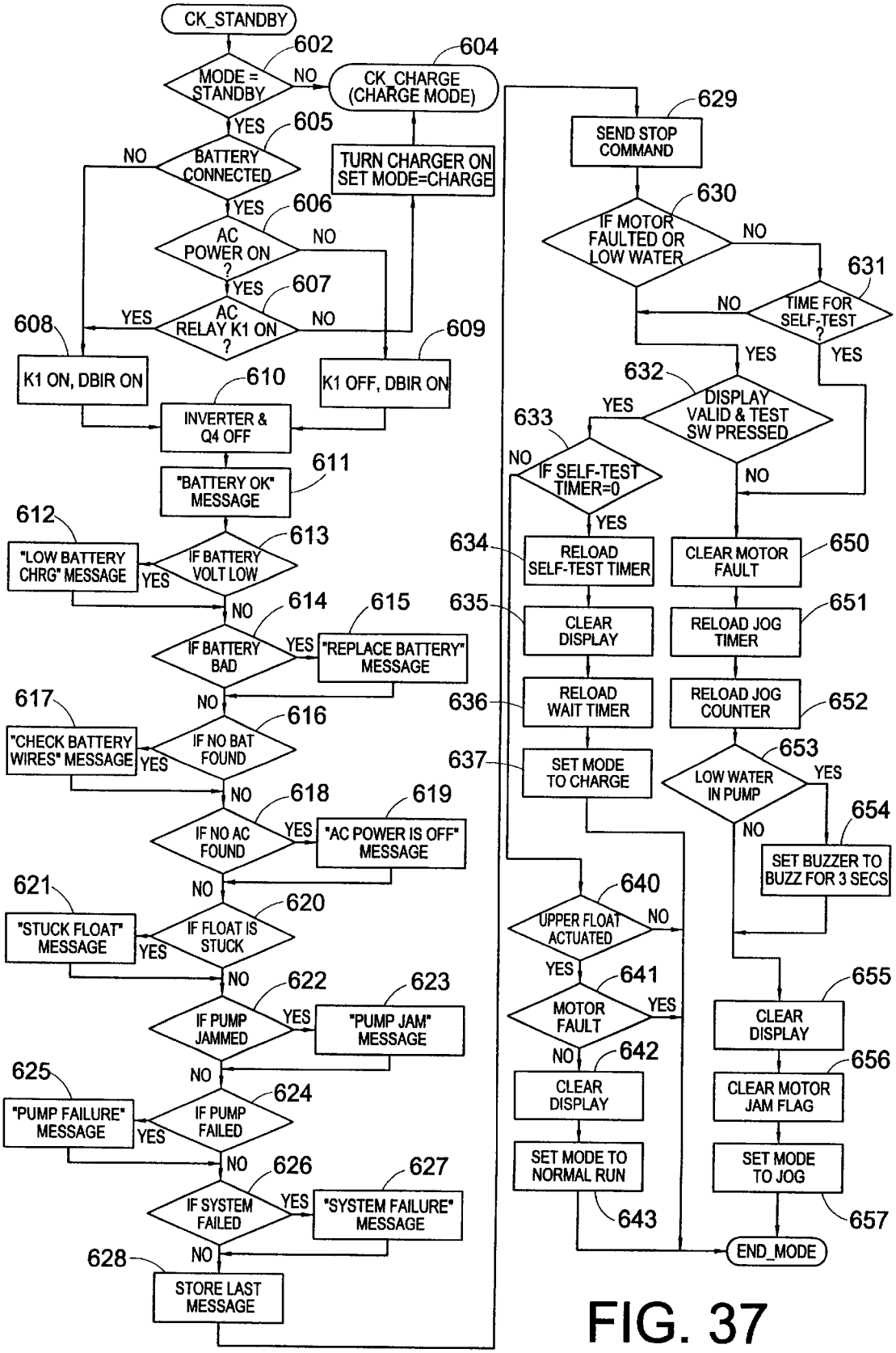
FIG. 37 is a flow chart of the pump control system in a standby mode.

FIG. 37 shows the standby mode 602 which defaults to the charge mode 604. With the system in standby mode, the system checks whether there is battery power 605, whether there is AC power 606 and whether AC power relay contact K1 of FIG. 33 is on 607. The system checks whether relay contact K1 of FIG. 33 is closed 608 or open 609 and whether MOSFAT Q4 of FIG. 33 is off 610. A battery OK or battery charge message 611, 612 is displayed if the battery voltage is low 613. If the battery is bad 614, a replace battery message 615 is displayed. If no battery is found 616, check battery wires message 617 is displayed. If no AC power is found 618, AC power off message 619 is displayed. If a float is stuck 620, a stuck float message 621 is displayed. If the pump is jammed 622, a pump jam message 623 is displayed. If the pump fails 624, a pump failure message 625 is displayed. If the system fails 626, a system failure message 627 is displayed. The last message is stored at 628 and a stop command is sent 629. The system checks for a motor fault or low water 630. If the answer is no, the system checks whether it is time for the 24 hour self test 631. When the manual test switch is pressed 632, the system checks whether the self test timer is at zero 633. If it is, the self test timer is reloaded 634, the display is cleared 635, and the wait timer is reloaded 636 and the mode is set to charge 637.

If the self test timer is not at zero 633, the system checks whether the upper float is actuated 640. If it is, the system checks for a motor fault 641 and if there is none, the display is cleared 642 and the system is set to run in the normal mode 643. If the upper float is not actuated at 640 or there is a motor fault at 641, the system defaults to the end mode.

If it is time for a self test 631, the motor fault indication is cleared 650, the jog timer is reloaded 651 and the jog counter is reloaded 652. The system checks for low water in the pump 653 and sets the buzzer to buzz for three seconds 654 if the water is low. If the water is not low, the display is cleared 655, the motor jam flag is cleared 656, the mode is set to jog 657 which is followed by the end mode after a jog operation.

A brief summary of the system and its operation follows. A complete system includes a pump A with motor controller 131, a system controller J, a remote display unit K and one or two lead acid batteries as shown in FIG. 32.

Major components of the pump are a brushless dc stator D, a motor rotor 20 and pump impeller C, floats 52, 54 and float switches 161, 162, and electronics on motor controller 131.

The pump can function as a stand alone unit, turning on when upper float 52 is floating and turning off when both floats drop. All that is required in the stand-alone mode is a 24 VDC 10 amp dc supply. In the event of an impeller jam, current is limited locally on the motor controller 131. If current limit continues for two seconds, the motor controller 131 will disable itself for approximately six seconds, then try to restart. This cycling process will continue indefinitely.

When connected to system controller J, the pump becomes a slave to the system controller, following commands sent via a two way communication scheme using five volt logic signals injected between the DC common and ground wires. Communication is asynchronous and is controlled by the motor controller 131. Data is transferred in 16 bit packets. Bit transfers occur on an 8.2 ms interrupt. Current limit is still controlled locally, but if a jam is detected by the system controller, an unclog sequence will be attempted. This unclog sequence is totally directed by the system controller J.

Major components of the display are a 1×16 LCD, an optional backlight, a piezoelectric buzzer, a tri-color LED indicator and pushbuttons. The display connects to the system controller J via a four conductor modular cable. Five volt DC power and communication signals are carried by this cable. The communication scheme uses a synchronous clock signal generated by the system controller J. Data is sent in 16 bit packets. Data transfers from the system controller J to the remote display unit occur on falling clock edges and transfers from remote display unit to the controller on rising clock edges. All text messages are hard coded in the remote display unit and are selected by a code sent from the system controller J. Similar codes are used to turn on the LED and buzzer. Pushbutton events are detected by the remote display unit and sent to the system controller J.

Major components of system controller J are an AC to DC power supply, a current mode regulator, a DC step up converter and a microprocessor control. The system controller J steps AC line power down to approximately 40 VDC unregulated power using power transformer T1, schottky diodes D1*a*, D1*b*, C1,2 and the drain-source diodes of Q1 and Q2. This unregulated power is fed into a buck switch mode regulator 243 consisting of Q3, D3*a*, D3*b*, L1, C3,4, 5,6 and R2. The regulated output can be used to power the pump or charge the batteries. Actual output voltage can be selected between the following values: 0.0, 13.8, 24.0, 27.6 and 30 VDC. Battery charging does not occur when the pump is running. Q4 is turned on to provide a current path for charging.

When AC power is not present and the pump is idle, battery power at 12 or 24 VDC is supplied to the pump through the drain-source diode of Q4.

If the upper float switch begins floating and it is a two battery system, Q4 is turned on to supply 24 volt power to the pump. If it is a one battery system, then Q4 remains off, K3 closes and Q1 and Q2 are alternately turned on for a 50% duty cycle. This action forces current into the secondary of transformer T1 of FIG. 33, stepping up the battery voltage. At the same time, K2 is closed, and D1*a* and D1*b* are active. Whenever AC is not present, K1 remains open, effectively disconnecting transformer T1 from the power line.

If the upper float switch remains floating for a predetermined time such as longer than around 10 seconds, then the controller supplies 30.0 VDC to the pump for high speed turbo operation. When AC is present, then the 40 VDC unregulated bus is simply regulated down to 30 VDC. If it is running on one battery, then battery voltage is boosted from 12 VDC to 30 VDC using Q1, Q2, D1*a*, D1*b*, K2 and T1. If it is running on two batteries, then battery voltage is boosted to 30 VDC using Q1, Q2, D2*a*, D2*b* and T1.

If the upper float remains floating longer than around 20 seconds, an indication that the pump cannot keep up is given by closing fault contacts and beeping continuously. If the pump begins running on battery, it is so indicated via a three second beep. If pump speed drops below 2500 rpm, assume a jam and try the unclog sequence. If the lower float is down and upper float is up, indicate a float stuck message. If communication is lost between the pump and controller, indicate a system fault and close fault contacts. If communication is lost between display and controller, close fault contacts. If AC power is off, indicate every hour by a series of three beeps. Indicate battery charge level by linear interpolation of battery voltage. This is meaningless during charging.

The test unclog sequence can be initiated by the user pressing the test button when in charge or standby modes with the caveat that the lower float switch must be floating for a self-test to be performed, otherwise a three second beep will alert the user; by the self test timer initiating a self-test every 48 hours; or by pump speed dropping below 2500 rpm during normal and turbo modes. The unclog sequence is carried out by first running the pump in reverse direction and stopping the pump when speed>2500 rpm or time>3 seconds. The pump then is run in the forward direction. The exit routine is exercised if speed>2500 rpm indicating the pump is okay. If speed<2500 rpm and time>3 seconds then repeat the previous steps up to four times. If forward speed does not exceed 2500 rpm, there is a pump failure.

Assume two 40 amp-hour batteries for a 24 VDC system or one 80 amp-hour battery for a 12 VDC system. A constant voltage charging method is used at 13.8 volts for one battery and 27.6 volts for two batteries. The switching regulator which supplies power to charge the batteries is the current mode bucking regulator 243 with a peak current output of 15 amps. If the charging current remains>1 amp for 24 hours, then this is a sign that the battery may need to be replaced. If battery operation occurs, this resets the timer. Once the replace battery flag is set, the system must be reset or powered down from both AC and battery to clear. The charging mode is automatically entered after any pump action, i.e. normal, turbo, self-test/unclog and power up. The charging mode is exited under the following conditions: Charging current<0.75 amps which includes no AC power because charging current is 0; Charging current>0.75 amps for 24 hours of total accumulated charging time since last battery usage which also sets the replace battery indication; The upper float switch is actuated; The test pushbutton is actuated; or The auto test timer triggers a test every 48 hours except that the self-test is not done if the lower float is not floating, and batteries are topped off after each self-test.

Charging current circuit is zeroed every minute during the charging mode to compensate for any zero offset drift in the current sensing circuit. Zeroing is accomplished by turning Q4 off, measuring the voltage generated by the current sense circuit and using this measurement as a zero current reading. A coarse zero adjustment is required at manufacture by adjusting a resistor to obtain a voltage between 0.5 and 1.0. Additionally, the number of batteries, either one or two or zero, is determined during this procedure. If battery voltage>18 VDC there are two batteries and if battery voltage>9 VDC there is one battery. If there is no voltage, the check battery wires is indicated. The low battery indication becomes active when battery voltage drops below 10.5 VDC per battery. Battery charge condition is based on a linear relationship of battery voltage where 10.5 VDC or less per battery is 0%, 13 VDC or greater per battery is 100%. Battery charge condition will always measure 100% when the battery is charging because the charge voltage is greater than the 100% voltage.

For the LED, a flashing red condition overrides flashing yellow which overrides a solid green condition. Yellow is displayed if in a test/unclog mode. Yellow is displayed if in turbo mode. Yellow is displayed if AC power is off. Yellow is displayed if low battery is detected. Red is displayed if there is a no battery or reverse polarity is detected. Red is displayed if there is a pump fault such as when the pump entered test/unclog mode and failed the test. Red is displayed if the lower float is down when the upper float is up. Red is displayed if there is an overcapacity condition such as when the upper float is up for more than 20 seconds. Red is displayed if there is a battery fault flag set such as when the battery charge current>0.75 amps for 24 hours. Red is displayed if there is a system fault such as when communication with the pump is lost.

The fault relay is active: when the pump is faulted such as by failing the test/unclog sequence; when a float is stuck as when the upper float is up, and the lower float is down; when the unit is in overcapacity as when the upper float is up for more than 20 seconds; during a system fault as when there is no communication with the pump; and during a display fault as when there is no communication with the display.

The buzzer sounds a three second tone if a self-test is attempted when the lower float is down. A three second tone sounds anytime the pump begins operating on battery. Three chirps are sounded each hour when AC is off. One chirp each minute if battery voltage is low, as long as one or two batteries are present. One chirp each minute if the bad battery flag is set as when the charge current>0.75 amp for 24 hours. One chirp each ½ second if there is an overcapacity condition as when the upper float is up for more than 20 seconds.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A monitoring and control system for a pump that has an electric motor and upper and lower floats comprising: sensor devices connected to sense a plurality of variable parameters including float position, motor speed, motor amps and motor elapsed running time and provide sensor signals representative of the sensed parameters;

a processor configured to receive and process said sensor signals to determine which of a plurality of different pump conditions that the pump is in and to generate output signals representative of the determined pump condition; and said plurality of different pump conditions including a normal motor condition, a jammed motor condition, an inadequate motor speed/pumping rate condition, a dry running condition and a stuck float condition.

2. The pump monitoring and control system of claim 1 wherein said output signals representative of a jammed motor condition provide rapid clockwise and counterclockwise energization of said pump motor to correct the jammed condition.

3. The pump monitoring and control system of claim 1 wherein said output signals representative of an inadequate motor speed/pumping rate condition provide higher speed operation of said pump motor than normal pump motor speed.

4. The pump monitoring and control system of claim 1 wherein said output signals representative of a dry running condition shuts down the pump motor and provides warning signals.

5. The pump monitoring and control system of claim 1 wherein said output signals representative of a stuck float condition provide rapid clockwise and counterclockwise energization of said pump motor to free the stuck float.

6. The pump monitoring and control system of claim 1 wherein said pump has both AC and battery power sources and normally is connected to said AC power source, and said processor being configured to check the availability of AC power and to connect said pump for operation from said battery power source when AC power is unavailable.

7. The pump monitoring and control system of claim 1 including a display for displaying information about said plurality of different pump conditions, and said processor being configured to provide signals to said display for displaying information about the condition that the pump is in.

8. In a sump pump having a reversible electric motor and upper and lower floats for starting and stopping pump operation in response to water level in a sump, a pump control system that having monitoring devices connected to monitors a plurality of different pump parameters including pump motor speed, pump motor amps, float position and pump operating time, said monitoring devices providing signals representative of said pump parameters, said control system including a processor configured to receive and process said signals from said monitoring devices to determine the pump condition and generate output signals representative of the determined pump condition, said processor responding to operation of said pump for longer than a predetermined time by generating an output signal for increasing the motor speed, said processor responding to a stuck float or motor by generating output signals for providing rapid clockwise and counterclockwise energization of said motor, and said processor responding to operation of said motor at normal speed while drawing low amps by generating an output signal for deenergizing said motor.

9. The pump of claim 8 including AC and battery power sources, said control system having a monitoring device that monitors availability of AC power and provides AC power availability signals to said processor, said processor being configured to receive and process said AC power availability signals to automatically connect said pump motor to said battery power source when AC power is unavailable.

10. The pump of claim 8 including an information display that displays information on the condition of the pump.

11. A programmed control system for controlling a sump pump having a reversible motor and upper and lower floats, monitoring devices connected to monitor a plurality of variable pump conditions including motor speed, motor amps, motor elapsed run time and float position and to provide pump condition signals representative of the monitored pump conditions, a processor configured to receive and process said pump condition signals and to generate output signals representative of the determined pump condition to operate said motor at a normal speed when both floats are floating and to operate said motor at a higher speed than said normal speed when both of said floats have been floating for longer than a predetermined time.

12. The control system of claim 11 wherein said motor draws normal amps when running at normal speed while said pump is pumping water and draws low amps when running at normal speed in the absence of water, and said processor being configured to deenergize said motor in response to sensing low amps while said motor is running at normal speed.

13. The control system of claim 11 wherein said motor draws high amps when energized while jammed against rotation, said processor being configured to alternately reverse said motor at high frequency for vibrating and shaking said pump to unjam said motor.

14. The control system of claim 11 wherein said pump is connected with both AC and battery power sources, said processor being configured to operate said motor on said AC power source when it is available and to automatically operate said motor on said battery power source when said battery power source is unavailable.

15. The control system of claim 14 wherein said motor is operable on 24 volts and said battery power source is either 12 volts or 24 volts, said processor being configured to automatically step up 12 volts to 24 volts when said battery power source is 12 volts.

16. The control system of claim 11 including an information display for indicating the condition of said pump, said processor being configured to provide information signals to said information display, said conditions displayed on said information display including availability of AC power, operating on battery power, stuck float, jammed motor and flooding.

17. The control system of claim 11 wherein said processor is configured to respond to a stuck float condition wherein said upper float is floating and said lower float is not floating by alternately reversing said motor at high frequency for vibrating and shaking said pump to free a stuck float.

18. A method for monitoring the condition of a sump pump having a reversible electric motor, sensor devices, a processor and a display and upper and lower floats comprising the steps of monitoring a plurality of variable parameters including pump motor speed, pump motor amps, float position and pump operating time by said sensor devices, categorizing the pump as being in one of a plurality of different conditions in response to said parameters by said processor, said different conditions including normal, a jammed motor, a stuck float, dry running and an inadequate pumping rate, and providing display information as to the condition the pump is in to said display.

19. The method of claim 18 including the steps of jogging said motor in alternate reverse directions to shake and vibrate same in response to a jammed motor or a stuck float, and energizing said motor at a higher speed in response to an inadequate pumping rate.

20. A method for monitoring the condition of a sump pump having a reversible electric motor, sensor devices and a processor comprising the steps of monitoring a plurality of variable parameters including pump motor speed, pump motor amps, pump operating time and sump liquid level by said sensor devices, and categorizing the pump as being in one of a plurality of different conditions in response to said monitored parameters by said processor, said different conditions including normal, a jammed motor, dry running and an inadequate pumping rate.

21. The method of claim 20 including the step of increasing the motor speed in response to a determination that the pump is in an inadequate pumping rate condition.

22. The method of claim 20 including the step of alternately energizing the pump motor in clockwise and counterclockwise directions in response to a determination that the motor is jammed.

23. The method of claim 21 including the step of shutting down the pump motor in response to a determination that the pump is in a dry running condition.

24. The method of claim 21 including the step of providing display information as to the condition that the pump is in.

25. A method for monitoring the condition of a sump pump having a reversible electric motor, sensor devices, a processor and upper and lower floats comprising the steps of monitoring a plurality of variable pump parameters by said sensor devices that enable a determination of a plurality of different pump operating conditions including a normal condition, a jammed motor condition, a dry running condition, and an inadequate pumping condition, and said processor using the monitored parameters to determine which of the conditions that the pump is in.

26. The method of claim 25 including the steps of alternately energizing the motor in clockwise and counterclockwise directions in response to a determination that the pump is in a jammed motor condition, shutting down the motor in response to a determination that the pump is in a dry running condition, and increasing the motor speed in response to a determination that the pump is in an inadequate pumping rate condition.

27. A pump monitoring and control system for a pump that is positionable in a sump and has an electric motor comprising: sensing means for sensing a plurality of variable parameters including motor amps, motor elapsed run time and sump liquid level to provide signals representative of the sensed parameters, processor means for receiving and processing said signals from said sensing means to determine which of a plurality of different pump conditions the pump is in and generate output signals representative of the determined pump condition; and said plurality of different pump conditions including a normal motor condition, a jammed motor condition, an inadequate motor speed/pumping rate condition and a dry running condition.

28. The pump monitoring and control system of claim 27 wherein said plurality of variable parameters that are sensed by said sensing means includes pump motor speed.

29. The pump monitoring and control system of claim 27 wherein said output signals representative of a jammed motor condition provide rapid clockwise and counterclockwise energization of said pump motor, wherein said output signals representative of an inadequate pumping rate condition provide higher speed operation of said pump motor than normal pump motor speed, and wherein said output signals representative of a dry running condition shuts down the pump motor.

30. In a sump pump system having a reversible electric motor and sump water level control means for starting and stopping pump operation in response to different water levels in a sump, a pump control system that includes means for monitoring a plurality of different pump conditions including pump motor speed, pump motor amps, pump operating time and sump water level, said control system including means responsive to operation of said pump for longer than a predetermined time by increasing the motor speed, said control system including means responsive to a jammed motor by providing rapid clockwise and counter-clockwise energization of said motor, and said control system including means responsive to operation of said motor at normal speed while drawing low amps by deenergizing said motor.

31. The pump of claim 30 including AC and battery power sources, said control system including means for monitoring availability of AC power and for automatically connecting said motor to the battery power source when AC power is unavailable.

32. The pump of claim 30 including an information display for displaying information on the condition of the pump, and said control system including means for providing signals representative of the pump condition to said information display.

33. A programmed control system for controlling a sump pump having a reversible electric motor and upper and lower floats, said control system including means for monitoring motor speed, motor elapsed run time and float position and providing monitored signals, processor means for receiving and processing said monitored signals and providing output signals to operate said motor at a normal speed when both floats are floating and to operate said motor at a higher speed than said normal speed when both of said floats have been floating for longer than a predetermined motor elapsed run time.

* * * * *